US011589655B2

(12) United States Patent
Paik et al.

(10) Patent No.: US 11,589,655 B2
(45) Date of Patent: Feb. 28, 2023

(54) BUCKLE

(71) Applicant: WOOJIN PLASTIC Co., Ltd., Namyangju-si (KR)

(72) Inventors: Ji Sook Paik, Seoul (KR); Nan Hee Paik, Seoul (KR); Ji Hye Paik, Seoul (KR); Ji Won Son, Seoul (KR)

(73) Assignee: WOOJIN PLASTIC Co., Ltd., Namyangju-si (KR)

( * ) Notice: Subject to any disclaimer, the term of this patent is extended or adjusted under 35 U.S.C. 154(b) by 216 days.

(21) Appl. No.: 16/905,146

(22) Filed: Jun. 18, 2020

(65) Prior Publication Data

US 2020/0397098 A1 Dec. 24, 2020

(30) Foreign Application Priority Data

Jun. 18, 2019 (KR) ..... 10-2019-0071924

(51) Int. Cl.

| | |
|---|---|
| ***A44B 11/25*** | (2006.01) |
| *A42B 3/08* | (2006.01) |
| *A45F 3/04* | (2006.01) |

(52) U.S. Cl.

CPC ..... *A44B 11/258* (2013.01); *A42B 3/08* (2013.01); *A44D 2203/00* (2013.01); *A45F 3/04* (2013.01); *A45F 2003/045* (2013.01)

(58) Field of Classification Search

CPC ..... A42B 3/08; A44B 11/258

See application file for complete search history.

(56) References Cited

U.S. PATENT DOCUMENTS

| | | | | |
|---|---|---|---|---|
| 5,311,647 | A | 5/1994 | Levy | |
| 6,163,938 | A * | 12/2000 | Weber-Unger | A44B 13/0047 24/669 |
| 6,170,131 | B1 * | 1/2001 | Shin | A41F 1/002 24/66.1 |
| 6,292,985 | B1 * | 9/2001 | Grunberger | A44B 11/2592 24/616 |

(Continued)

FOREIGN PATENT DOCUMENTS

| | | |
|---|---|---|
| CN | 107635429 A | 1/2018 |
| EP | 3 183 986 A1 | 6/2017 |

(Continued)

OTHER PUBLICATIONS

Chinese Office Action for related CN application No. 202010490853.3 dated Sep. 5, 2022 from Chinese Patent Office.

*Primary Examiner* — Jason W San

(74) *Attorney, Agent, or Firm* — Paratus Law Group, PLLC

(57) ABSTRACT

Disclosed herein is a buckle including a plug member and a socket member. The plug member includes a shaft part protruding from one side of a first body, a first magnet inserted into the shaft part, a connection recess formed on the outer face of the shaft part, and at least one guide protrusion formed on the inner wall of the connection recess. The socket member includes a connection protrusion formed on one side of a second body to be inserted into the connection recess, a coupling recess formed in the middle of the connection protrusion so that the shaft part is inserted into the coupling recess, a second magnet inserted into the coupling recess, and at least one guide groove formed in the outer surface of the connection protrusion to guide the guide protrusion.

17 Claims, 26 Drawing Sheets

(56) References Cited

U.S. PATENT DOCUMENTS

| | | | | |
|---|---|---|---|---|
| 6,857,169 | B2 * | 2/2005 | Chung | A44B 11/258 24/303 |
| 8,505,174 | B2 * | 8/2013 | Fildan | A41F 1/002 24/669 |
| 9,307,808 | B1 * | 4/2016 | Lill | A44B 99/00 |
| 11,160,330 | B1 * | 11/2021 | Tseng | A44B 11/258 |
| 2002/0112327 | A1 | 8/2002 | Baloga | |
| 2003/0213106 | A1 * | 11/2003 | Ichikawa | A44B 19/388 24/433 |
| 2004/0107547 | A1 * | 6/2004 | Chung | A44B 11/258 24/303 |
| 2008/0047111 | A1 | 2/2008 | Garber | |
| 2012/0044031 | A1 * | 2/2012 | Ninomiya | A44C 5/2085 335/219 |
| 2012/0124786 | A1 * | 5/2012 | Fiedler | A45C 13/1069 24/303 |
| 2014/0339232 | A1 * | 11/2014 | Fiedler | A44B 11/258 220/348 |
| 2015/0135486 | A1 * | 5/2015 | Fiedler | A44B 11/2584 24/303 |
| 2017/0172262 | A1 * | 6/2017 | Paik | A44B 11/2588 |
| 2019/0174875 | A1 * | 6/2019 | Cheng | B62B 9/24 |
| 2022/0047045 | A1 * | 2/2022 | Li | A44B 11/258 |
| 2022/0330664 | A1 * | 10/2022 | Li | A44B 11/258 |

FOREIGN PATENT DOCUMENTS

| | | | |
|---|---|---|---|
| JP | 2013-063258 | A | 4/2013 |
| KR | 20-1983-0001167 | | 10/1983 |
| KR | 10-1747187 | B1 | 6/2017 |
| KR | 10-1811501 | B1 | 12/2017 |

* cited by examiner (a)

(b)

(a)

(b)

(a)

(b)

(c)

(a)

(b)

(a)

(b)

(a)

(b)

BUCKLE

CROSS-REFERENCE TO PRIOR APPLICATION

This application claims priority under 35 U.S.C. § 119 to Korean Application No. 10-2019-0071924 (filed on Jun. 18, 2019), which is hereby incorporated by reference in its entirety.

BACKGROUND

The present invention relates to a buckle, and more particularly, to a buckle, which includes a plug member and a socket member mounted at end portions of a belt or a strap attached to an article, such as clothes, bags, backpacks, helmets or others, to be coupled with each other detachably with a simple structure in a convenient operation.

In general, a buckle is a fastener having two members to be coupled with each other. Such a buckle has been widely used due to its lightweightness and easy fastening property since being made of a plastic material and is formed integrally so that the two members are combined with each other elastically.

FIG. 1 is a perspective view schematically illustrating a conventional buckle including a plug member 10 and a socket member 20.

As shown in the drawing, the plug member 10 includes: a body 11; a pair of lock arms 12 linearly protruding from the body 11 to have elasticity and respectively having fastening parts protruding from outer faces of front ends of the lock arms 12; and a guide rod 13 formed between the lock arms 12 to extend rectilinearly from the body 11. The socket member 20 includes: a chamber 21 opened from the front end to accommodate the plug member 10; and a pair of holes 22 respectively formed in both side walls to face each other so that the lock arms 12 are elastically combined with the holes 22.

When a user inserts the plug member 10 into the chamber 21 from a front end inlet of the socket member 20, outer faces of the lock arms 12 are bent inwardly flexibly while sliding along the inner wall of the socket member 20, and end portions of the lock arms 12 are returned outwardly flexibly while being located in the holes 22, so that the plug member 10 and the socket member 20 are coupled with each other.

After that, in order to release the buckle, the user presses both sides of the lock arms 12 exposed through the holes 22 so that the lock arms 12 are separated from the holes 22. When the plug member 10 is drawn out, the plug member 10 and the socket member 20 are separated from each other.

However, such a conventional buckle including a pair of the lock arms 12, the chamber 21 for accommodating the lock arms to be fastened, and the coupling structure existing therein has the complicated structure and requires considerable technical skills.

Moreover, the conventional buckle is fastened when the user grasps the plug member 10 and the socket member 20 with both hands and inserts and couples the plug member 10 into the socket member 20, and is released when the user grasps the plug member 10 and the socket member 20 with both hands and presses the lock arms 12. That is, the conventional buckle can be fastened only when the user precisely couples the plug member and the socket member with each other with both hands.

In order to operate a belt or a strap mounted on a backpack that a user wears for climbing a mountain or for going trekking, the user has to use his or her two hands to fasten the buckle after stopping all other motions. That is, the user has to put down things, which the user holds in his or her hands, in order to use the belt or the strap. Therefore, there is a need of a buckle which can be fastened more conveniently.

Korean Patent No. 10-1747187 discloses a buckle invented in order to solve the above problems. The buckle disclosed in Korean Patent No. 10-1747187 does not have the lock arms for coupling the plug member and the socket member with each other but has magnets so that they can be combined with each other by inducement of a strong magnetic force as long as they are close to each other. That is, the buckle disclosed in Korean Patent No. 10-1747187 provides convenience since being fastened just with one hand and improves the productivity due to simplification in structure.

The buckle disclosed in Korean Patent No. 10-1747187 provides convenience since allowing the user to conveniently fasten and unfasten the buckle, but has a fatal problem in restriction or safety of things by fastening since the plug member and the socket member are easily separated from each other by external contact or external pressure.

Therefore, there is a need of a buckle which can provide convenience by the simple fastening and keep the fastened state stable.

SUMMARY

Accordingly, the present invention has been made to solve the above-mentioned problems occurring in the prior arts, and it is an object of the present invention to provide a buckle, which includes a plug member and a socket member with a simple structure to be coupled and fastened with each other conveniently and to be applicable to belts or straps of various kinds.

It is another object of the present invention to provide a buckle which includes a plug member and a socket member coupled with each other as long as they are close to each other and coupled and fastened with each other conveniently with one hand.

It is a further object of the present invention to provide a buckle which is used in safety since the fastened state of the plug member and the socket member can be kept in stability.

It is a still further object of the present invention to provide a buckle capable of being utilized widely since not only buckles but also rings, whistles, strap fasteners, hooks and others with various functions may be added.

To accomplish the above object, according to the present invention, there is provided a buckle including: a plug member having a shaft part protruding from one side of a first body, a first magnet inserted into the shaft part, a connection recess formed on the outer face of the shaft part, and at least one guide protrusion formed on the inner wall of the connection recess; and a socket member having a connection protrusion formed on one side of a second body to be inserted into the connection recess, a coupling recess formed in the middle of the connection protrusion so that the shaft part is inserted into the coupling recess, a second magnet inserted into the coupling recess, and at least one guide groove formed in the outer surface of the connection protrusion to guide the guide protrusion, wherein the plug member and the socket member are coupled with each other in a detachable manner.

Moreover, the guide groove formed in the outer surface of the connection protrusion of the socket member may have an inclined approach formed to be inclined from an entrance where the guide protrusion of the plug member enters to the middle.

Furthermore, the entrance of the guide groove may be expanded in two ways so that the guide protrusion enters easily.

Additionally, the guide protrusion may be inclined in the same direction as the inclined approach.

In addition, the guide groove formed in the outer surface of the connection protrusion of the socket member may include a retaining groove having a retaining part formed in the middle of the retaining groove, and the guide protrusion of the plug member coupled to the retaining groove may include a retaining protrusion which is caught to the retaining part not to be separated from the socket member.

Moreover, a pair of the guide grooves may be disposed to face each other, a pair of the retaining grooves may be disposed to face each other, a pair of the guide protrusions coupled to the guide grooves may be disposed to face each other, and a pair of the retaining protrusions coupled to the retaining grooves may be disposed to face each other.

Furthermore, each of the retaining grooves may have an inclined approach formed to be inclined from an entrance where the retaining protrusion enters to the middle, the retaining part may be formed to be opposed to the inclined approach, and a horizontal movement section may be formed at the end of the inclined approach and below the retaining part.

Additionally, a pair of the retaining protrusions facing each other may be formed to be deviated from the center.

In addition, the retaining part may have a stepped jaw formed at the front end portion thereof.

Moreover, the retaining protrusion may have a stepped jaw formed on the surface getting in contact with the retaining part.

Furthermore, a cap may be mounted on the outer surface of the first body of the plug member to prevent foreign matters from flowing into the plug member.

Additionally, the first body may have at least a pair of grooves formed in the outer surface of the first body and a retaining jaw formed therein, and the cap may have a hook part coupled to the retaining jaw.

In addition, the first body or the second body may have a cross bar and a strap hooking bar selectively formed at one side.

Moreover, the first body or the second body may have an elevator rail holder disposed at one side.

Furthermore, a connection member selected from a ring, a clip, a hook, a buckle, and a strap connector may be disposed integrally with one side of the body of the plug member or the socket member to be applicable for various purposes.

Additionally, the first body or the second body may have a whistle attached to one side.

In addition, the first body or the second body may have a flat connector disposed at one side and sewed to a bag or a strap.

Moreover, the buckle according to the present invention may further include a connection member having a third magnet, the connection member and the plug member are coupled with each other by magnetism of the first magnet and the third magnet, or the connection member and the socket member are coupled with each other by magnetism of the second magnet and the third magnet.

Furthermore, the connection member may have any one of a hose clip, a hydration tube clip, a light clip, a swiveling D-ring, and a swiveling O-ring.

The buckle according to the present invention has a simple structure, raises productivity, and reduces manufacturing costs since not having lock arms but having the magnets to couple and fasten the plug member and the socket member.

The buckle according to the present invention can be fastened conveniently just with one hand since the plug member and the socket member are coupled with each other by inducement of a strong magnetic force of the magnets attached to the plug member and the socket member as long as they are close to each other, and can keep the coupled state stable due to the grooves and protrusions correspondingly formed on the plug member and the socket member.

Additionally, the buckle according to the present invention can be utilized widely since not only buckles but also rings, whistles, strap fasteners, hooks and others with various functions may be added.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Figure 1:
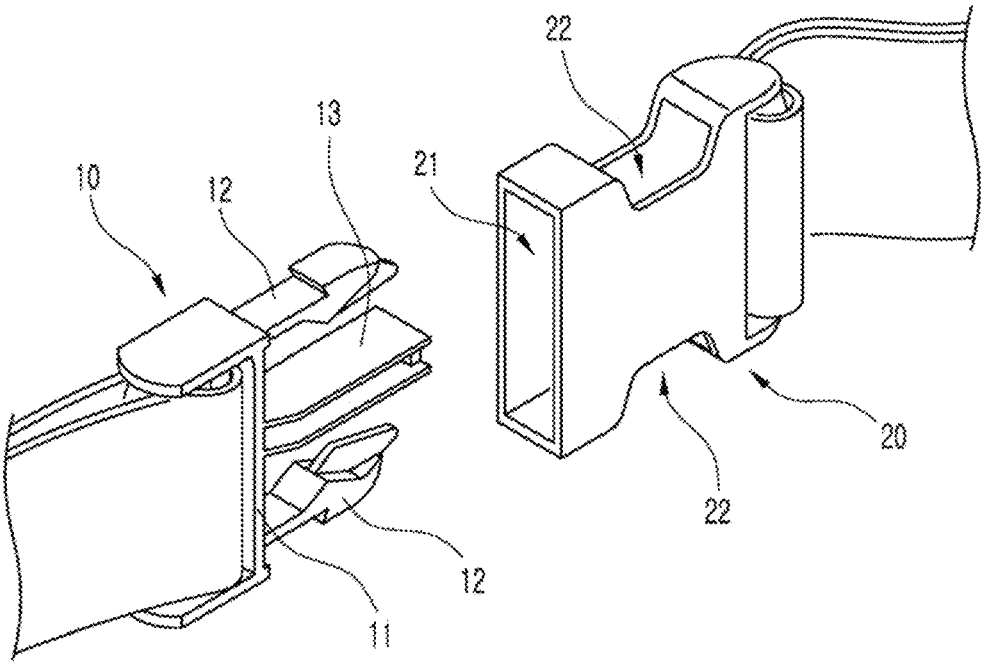
FIG. 1 is a view showing an example of a conventional buckle.

Hereinafter, an embodiment of the present invention will be described in detail with reference to the accompanying drawings.

In the drawings, thicknesses of lines and sizes of constituent elements may be exaggerated for clarity and convenience in explanation.

Furthermore, wordings to be described later are defined in consideration of the functions of the present invention, and may differ depending on the intentions of a user or an operator or custom. Accordingly, such wordings should be defined on the basis of the contents of the overall specification.

In drawings, the same reference numerals refer to the same or equivalent parts of the present invention.

FIGS. 2 to 10 illustrate a first embodiment of the present invention, namely, a buckle applicable to a backpack or others.

Figure 2:
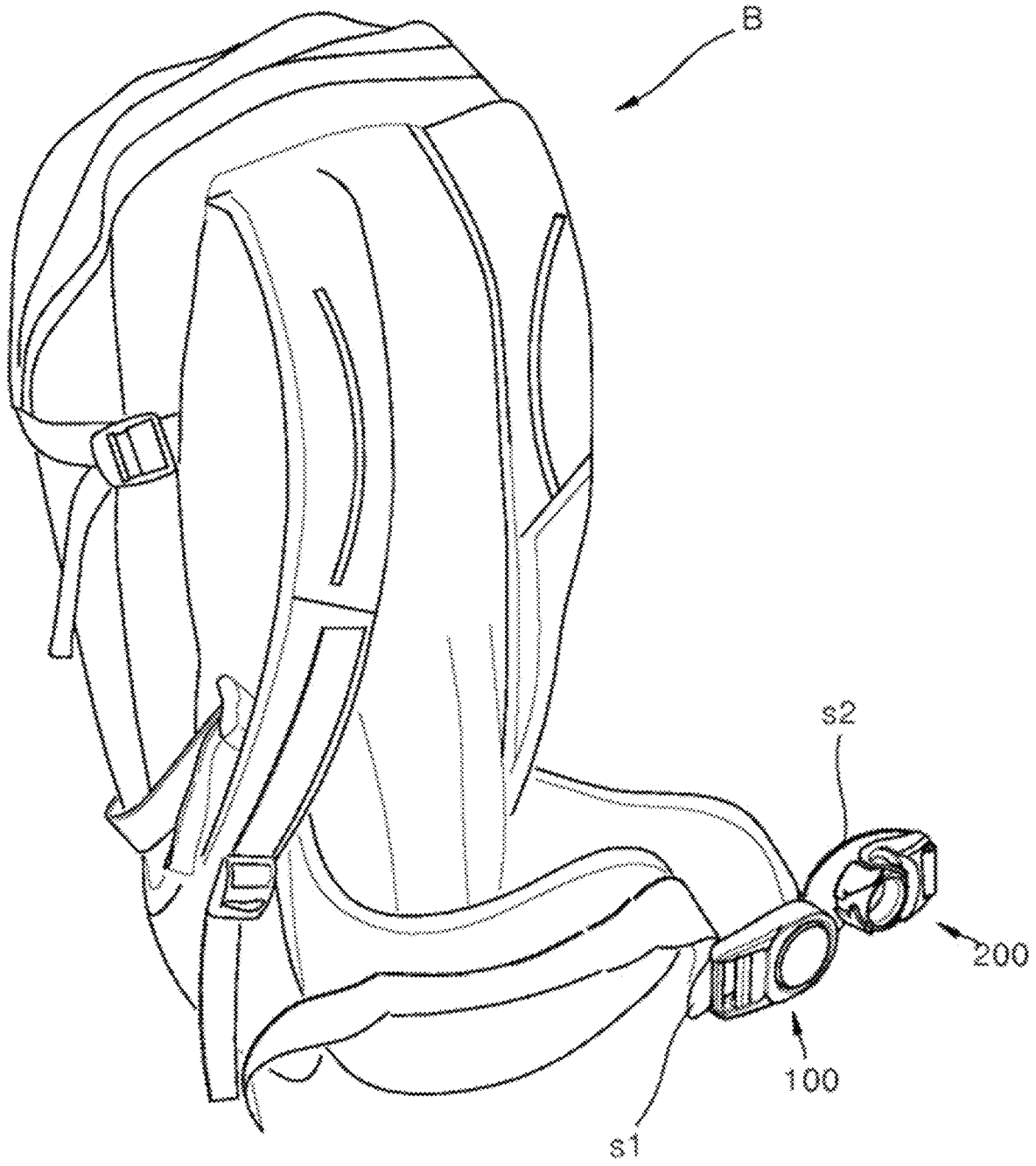
FIG. 2 is a view showing an example that a buckle according to the present invention is mounted on a backpack.
Figure 3:
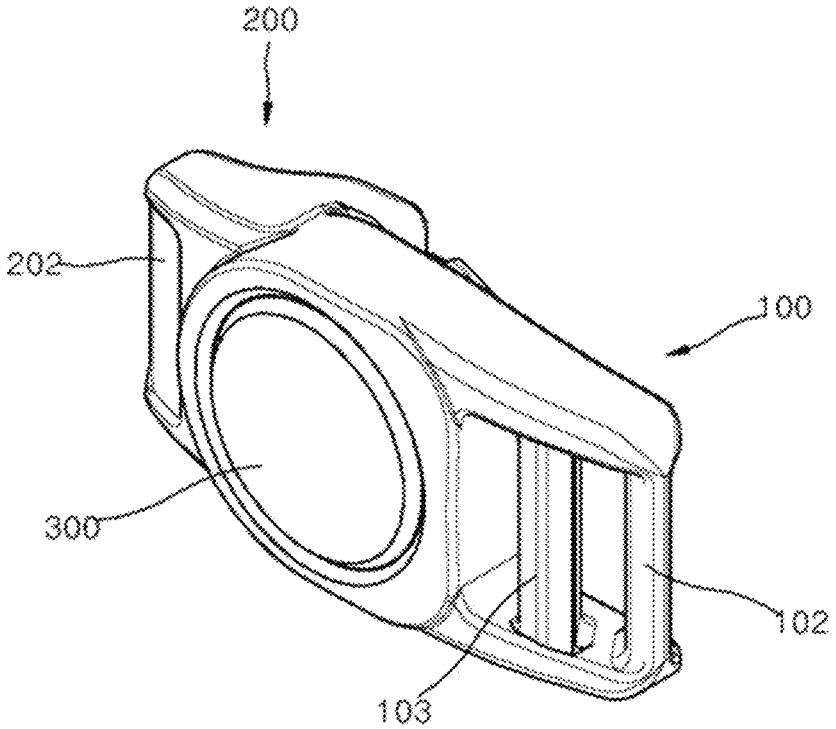
FIG. 3 is a perspective view and a rear side perspective view showing a buckle according to a preferred embodiment of the present invention.
Figure 3:
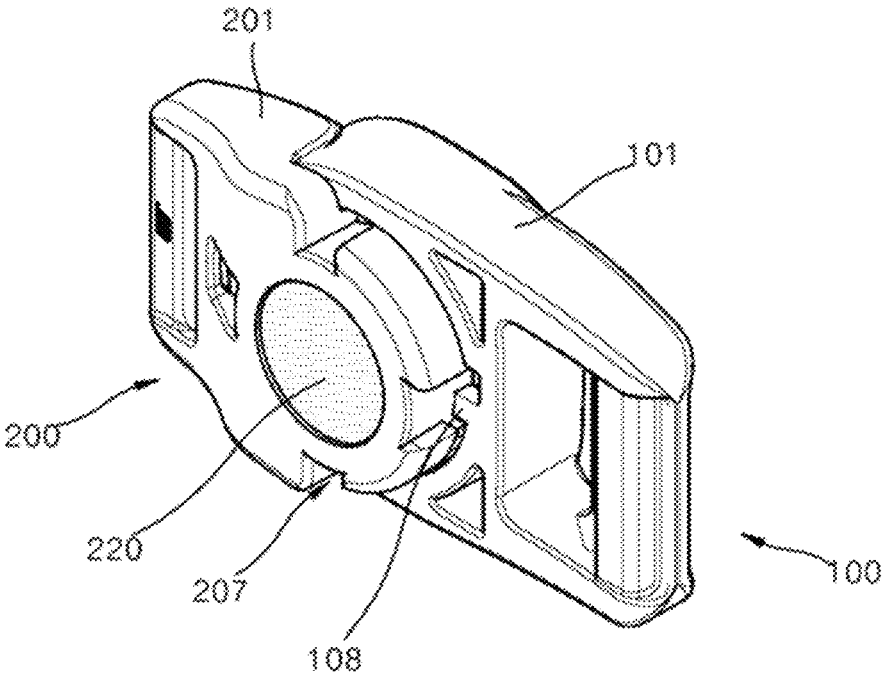
Figure 4:
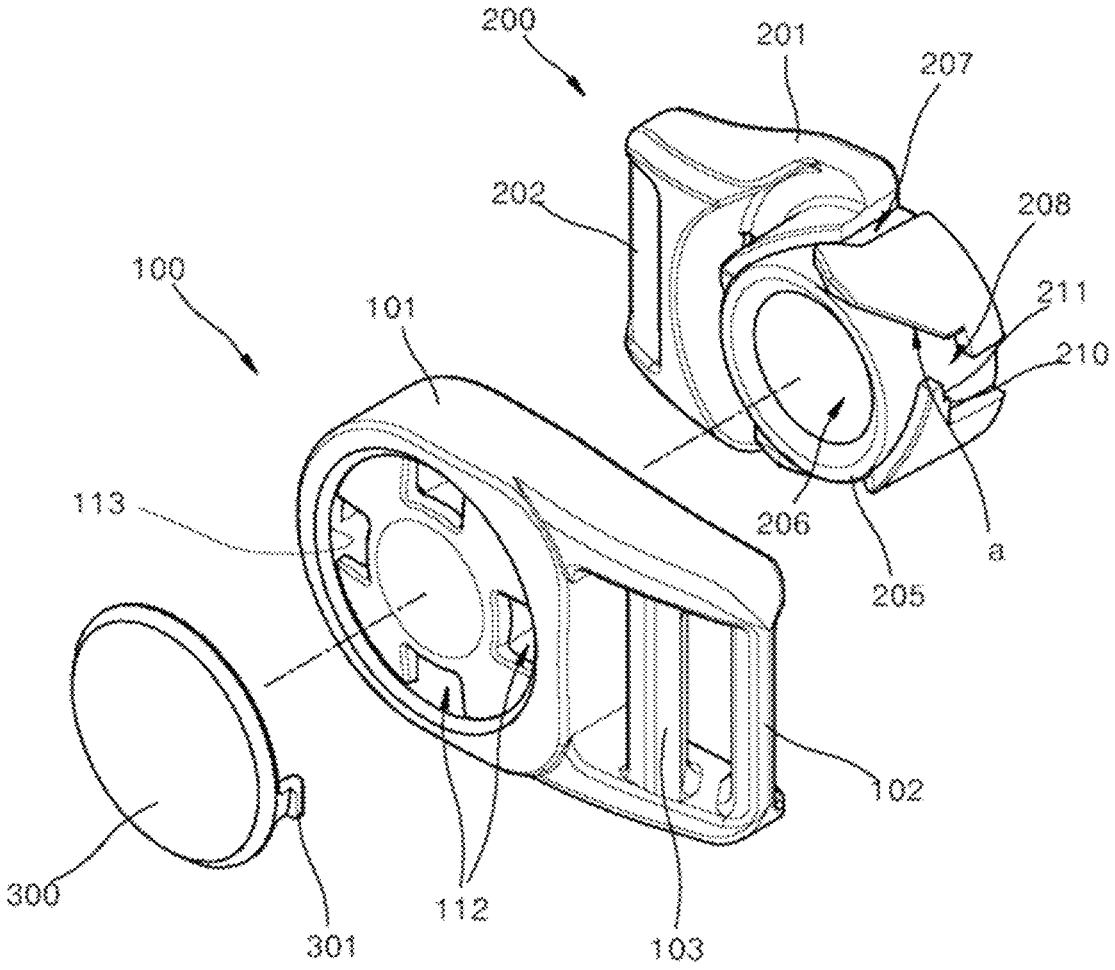
FIG. 4 is an exploded perspective view of FIG. 3.
Figure 5:
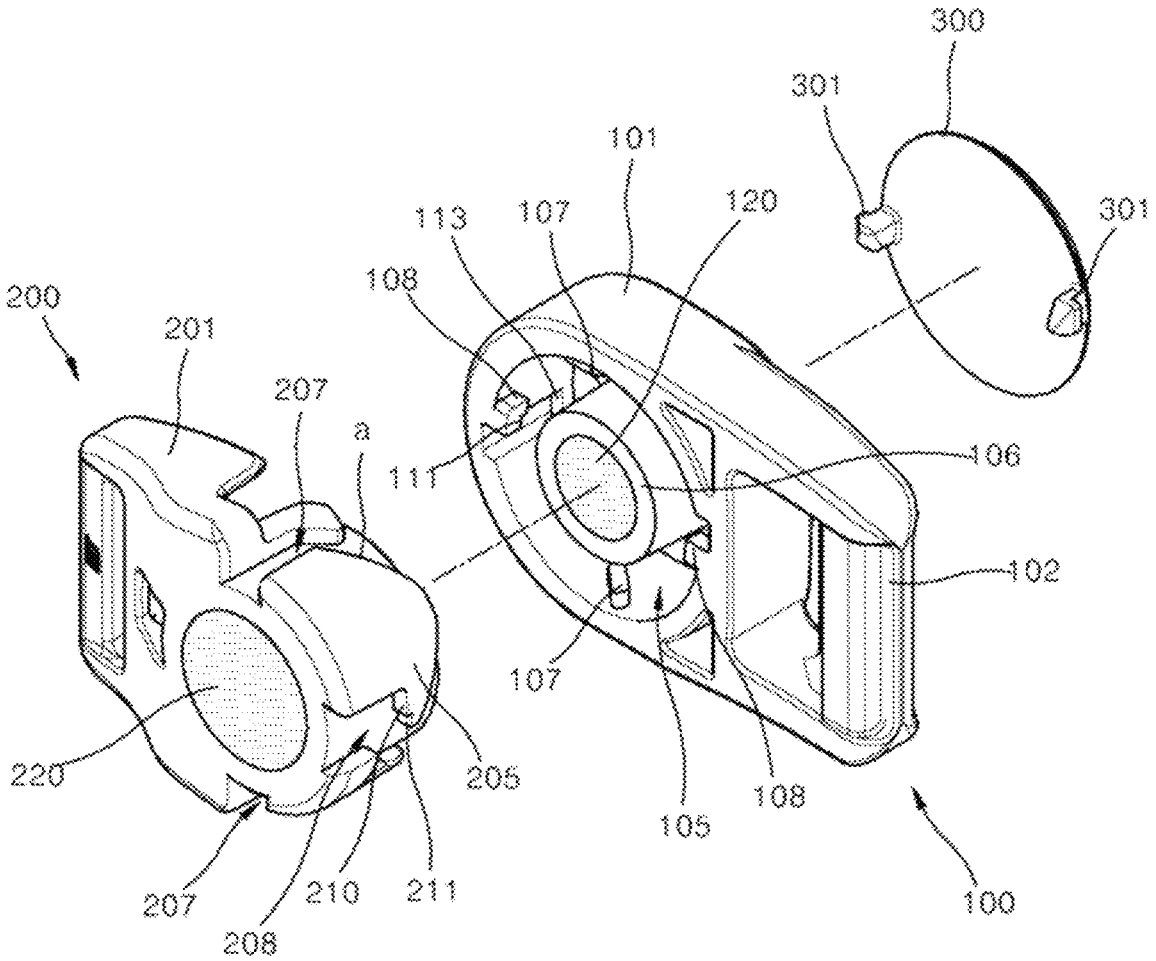
FIG. 5 is an exploded rear side perspective view of FIG. 4.
Figure 6:
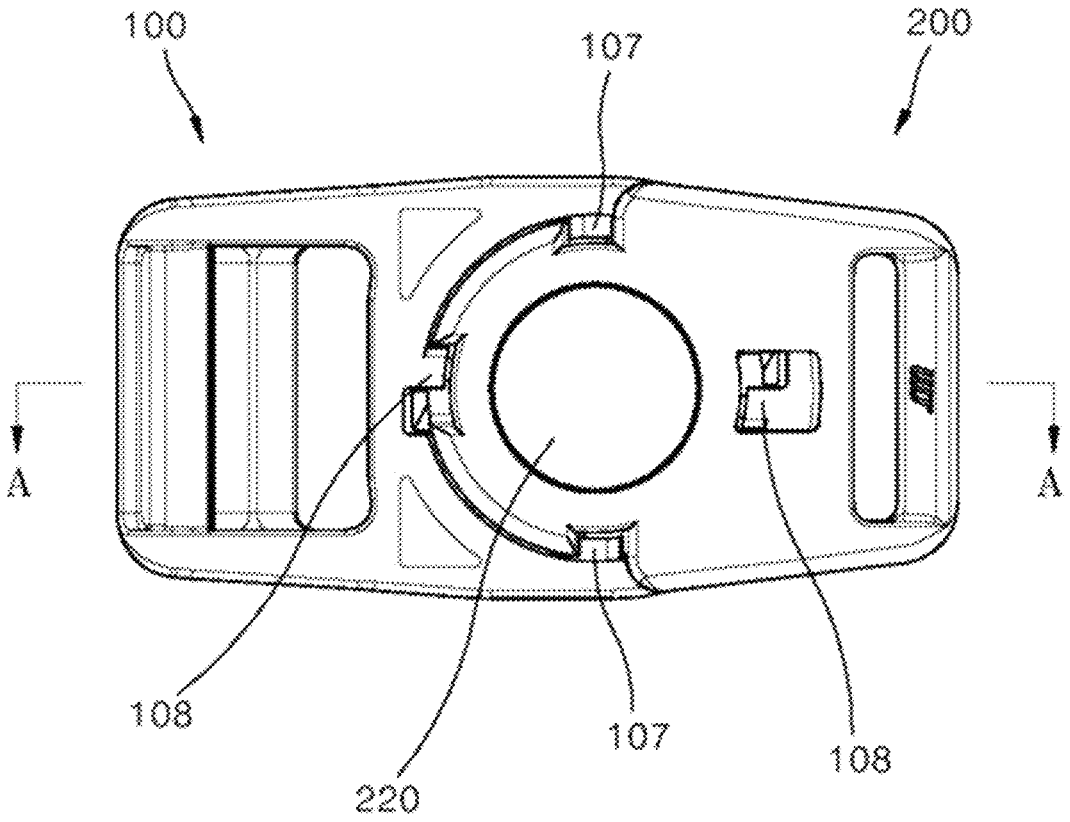
FIG. 6 is a front view of the buckle according to the present invention.
Figure 7:
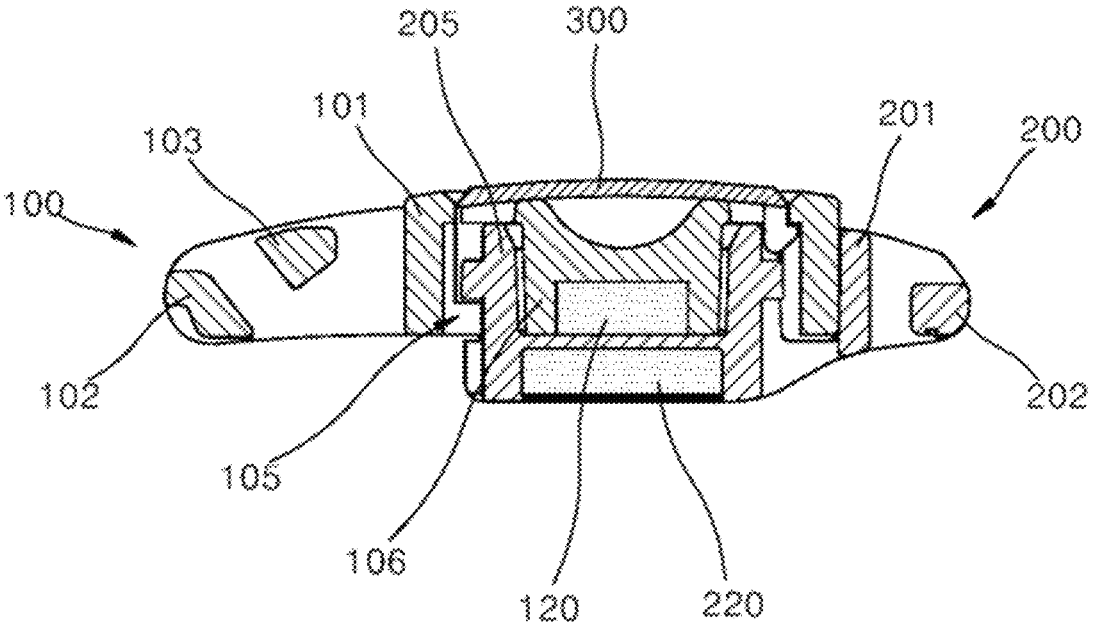
FIG. 7 is a sectional view taken along the line of A-A of FIG. 6.

FIG. 2 is a view showing an example that a buckle according to the present invention is mounted on a backpack, FIG. 3 is a perspective view and a rear side perspective view showing a buckle according to a preferred embodiment of the present invention, FIG. 4 is an exploded perspective view of FIG. 3, FIG. 5 is an exploded rear side perspective view of FIG. 4, FIG. 6 is a front view of the buckle according to the present invention, and FIG. 7 is a sectional view taken along the line of A-A of FIG. 6.

Referring to FIGS. 2 to 7, the buckle according to the first embodiment of the present invention includes a plug member 100 and a socket member 200 which are detachably coupled with each other. The plug member 100 and the socket member 200 are generally molded of synthetic resin, and are connected to straps s1 and s2 for a backpack B as shown in FIG. 2 to be used.

The plug member 100 includes a first body 101, and a cross bar 102 and a strap hooking bar 103 formed at one side of the first body 101 to traverse vertically so that a free end portion of the strap s1 is caught to the cross bar 102 and the strap hooking bar 103 to be connected to the plug member 100. The strap s1 is wound on the cross bar 102 and the strap hooking bar 103 alternately to be controlled in length.

The plug member 100 further includes a round connection recess 105 formed in one side of the first body 101, and a shaft part 106 protruding from the center of the connection recess 105, and a first magnet 120 is mounted on the shaft part 106.

The socket member 200 includes a cross bar 202 formed at one side of a second body 201 for fixing a free end portion of the other strap s2, and the strap s2 is wound on the cross bar 202 and is fixed by sewing.

Alternately, the socket member 200 may further include a strap hooking bar like the plug member 100 in order to control the length of the strap.

The socket member 200 further includes a ring-shaped connection protrusion 205 formed at one side thereof to be inserted into the connection recess 105 of the plug member 100, and a coupling recess 206 formed at the center of the connection protrusion 205 so that the shaft part 106 of the plug member 100 is inserted into the coupling recess 206. A second magnet 220 is mounted on the bottom surface of the coupling recess 206.

Therefore, when the connection recess 105 of the plug member 100 and the connection protrusion 205 of the socket member 200 are coupled with each other, the connection protrusion 205 is inserted into the connection recess 105, and at the same time, the shaft part 106 of the plug member 100 is inserted into the coupling recess 206 of the connection protrusion 205, so that the plug member 100 and the socket member 200 are very close to each other.

Here, because the connection recess 105 surrounds the connection protrusion 205, the connection protrusion 205 requires a space formed around the connection protrusion 205 so that the connection recess 105 is connected with the connection protrusion 205. Therefore, the connection protrusion 205 is spaced apart from the cross bar 202 formed at one side of the socket member 200.

Moreover, in the state where the plug member 100 and the socket member 200 are coupled with each other to be close to each other, the first magnet 120 and the second magnet 220 abut on each other and coincide with each other.

The buckle according to the present invention is fastened by magnetic force of the first magnet 120 and the second magnet 220. When the plug member 100 and the socket member 200 are close to each other, they are drawn to each other and are attached to each other in a moment by the magnetic force, so that the connection recess 105 of the plug member 100 and the connection protrusion 205 of the socket member 200 are closely coupled with each other.

A pair of opposed guide grooves 207 and a pair of opposed retaining grooves 208 are formed on the outer surface of the connection protrusion 205 of the socket member 200, and a pair of guide protrusions 107 inserted into the guide grooves 207 and a pair of retaining protrusions 108 inserted into the retaining grooves 208 are formed on the inner surface of the connection recess 105 of the plug member to face each other.

Figure 8:
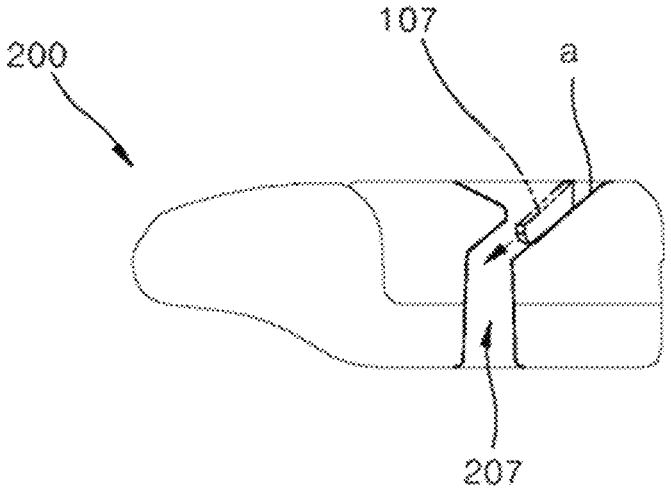
FIG. 8 is a side view schematically illustrating a guide groove and a retaining groove of a socket member according to the present invention.
Figure 8:
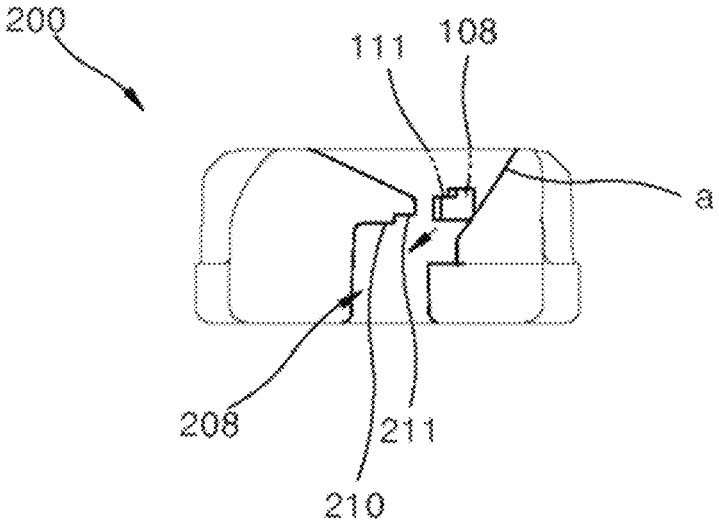

In FIGS. 8(*a*) and 8(*b*), the guide groove 207 and the retaining groove 208 are illustrated by contour lines in lateral views so that people can see easily. Referring to FIGS. 8(*a*) and 8(*b*), the guide groove 207 and the retaining groove 208 respectively have expanded entrances so that the guide protrusion 107 and the retaining protrusion 108 can enter easily, and inclined approaches (a) formed in the same direction to be inclined from the entrances to the middle of the outer face of the connection protrusion 205.

Here, the inclined approaches (a) of the guide groove 207 and the retaining groove 208 may be in a curved form.

The guide groove 207 and the guide protrusion 107 are coupling means for easily guiding coupling of the connection recess 105 and the connection protrusion 205, and the retaining groove 208 and the retaining protrusion 108 are fastening means for maintaining the coupled state.

The guide protrusion 107 corresponding to the guide groove 207 is not limited in its form, but preferably, is formed to be inclined in the same direction as the inclined approach (a) of the guide groove 207 for easy entry.

The retaining groove 208 has the inclined approach (a) formed from the entrance where the retaining protrusion 108 enters to the middle thereof in the inclined direction, and a retaining part 210 is formed across the inclined approach (a), and a horizontal movement section is formed at the end of the inclined approach (a) and below the retaining part 210.

Therefore, the retaining part 210 is at right angles to the coupling direction of the plug member 100 and the socket member 200.

The retaining protrusion 108 corresponding to the retaining groove 208 has a flat surface getting in contact with the retaining part 210 in order to maintain the retained state with the retaining part 210.

Additionally, as shown in the drawing, stepped jaws 211 and 111 are respectively formed at the front end portion of the retaining part 210 and a contact surface of the retaining protrusion 108 getting in contact with the front end portion of the retaining part 210. The stepped jaws 211 and 111 help to secure an entry space of the retaining protrusion 108 and to maintain the coupled state stable.

Figure 9:
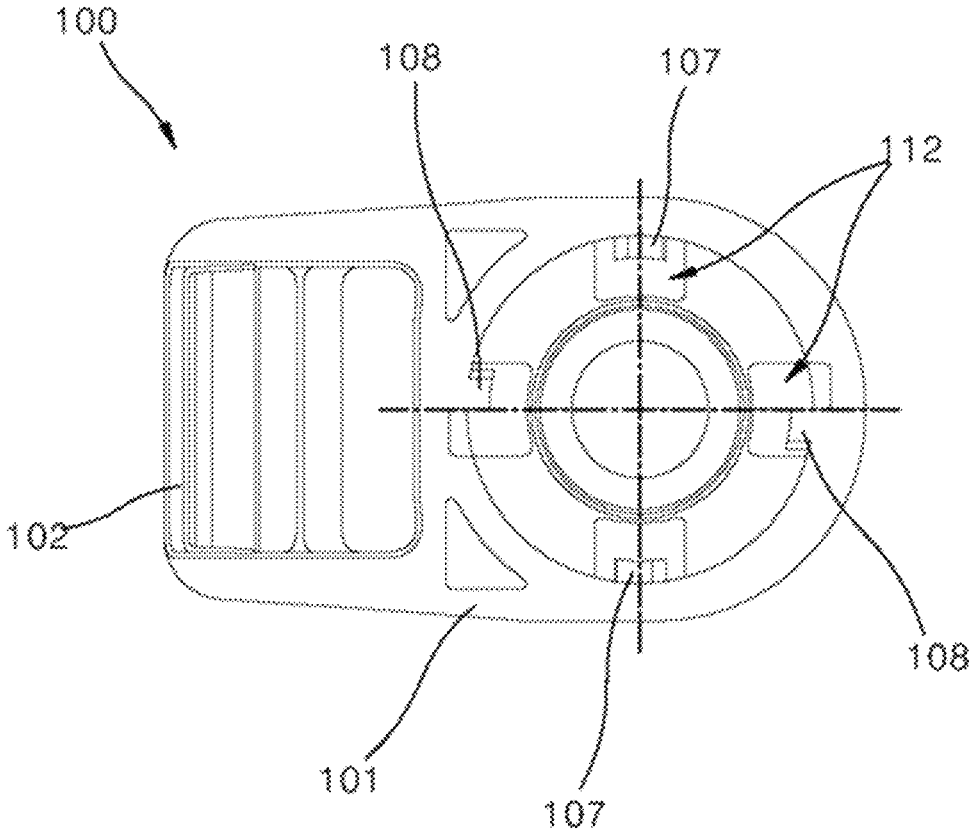
FIG. 9 is a plan view schematically illustrating a plug member according to the present invention.

FIG. 9 is a front view schematically illustrating the plug member 100 according to the present invention. Referring to FIG. 9, a pair of the guide protrusions 107 and a pair of the retaining protrusions 108 are mounted to face each other, and each of the retaining protrusions 108 is formed to be deviated from the center.

Especially, each of the retaining protrusions 108 is deviated in the direction to enter into the retaining groove 208. When the guide protrusion 107 and the retaining protrusion 108 respectively enter into the guide groove 207 and the retaining groove 208 and are respectively located in the middle of the guide groove 207 and the retaining groove 208, they are located on the inclined approaches (a), so may be separated from the guide groove 207 and the retaining groove 208 if there is no magnetic force of the magnets.

Therefore, each of the retaining protrusions 108 is further moved in a heading direction to be located on the retaining part 210 deviated from the inclined approach (a), and is separated only when being forcibly rotated in the opposite direction to the entry direction so as to get out of the contact state with the retaining part 210.

The guide grooves 207, the retaining grooves 208, the guide protrusions 107 and the retaining protrusions 108 according to the present invention are aligned at the connection protrusion 205 and the connection recess 105 in the form of a cross, but may be changed in the number or the alignment angle as a user wants.

In the meantime, the plug member 100 may include holes 112 in the bottom surface of the connection recess 105 to form the guide protrusions 107 and the retaining protrusions 108, and caps 300 may be mounted to cover the holes 112.

Each of the holes 112 has a retaining jaw 113 formed therein, and each of the caps 300 has a hook part 301 protrudingly formed to be coupled with the retaining jaw 113 so that the cap 300 covers the rear surface of the plug member 100 so as to provide a beautiful appearance and prevent inflow of foreign matters.

Now, an action of the buckle according to the present invention will be described as follows.

First, in order to couple the plug member 100 and the socket member 200 with each other, when one of the members approaches the other member, they are strongly drawn to each other by magnetism of the first magnet 120 and the second magnet 220, so that the first magnet 120 and the second magnet 220 are attached to each other in a moment and the plug member 100 and the socket member 200 are closely coupled with each other.

The shaft part 106 of the plug member 100 is inserted into the coupling recess 206 of the socket member 200 to get in close contact with the coupling recess 206, and at the same time, the connection protrusion 205 of the socket member 200 is inserted into the connection recess 105 of the plug member 100 to get in close contact with the connection recess 105. So, the plug member 100 and the socket member 200 are automatically coupled with each other by being drawn by the strong magnetism of the magnets in a moment. During such a momentary coupling, the guide protrusion 107 and the retaining protrusion 108 of the plug member 100 are respectively inserted into the guide groove 207 and the retaining groove 208 of the socket member 200, and the retaining protrusion 108 is seated on the retaining part 210 while getting in contact with the retaining part 210 of the retaining groove 208.

Figure 10:
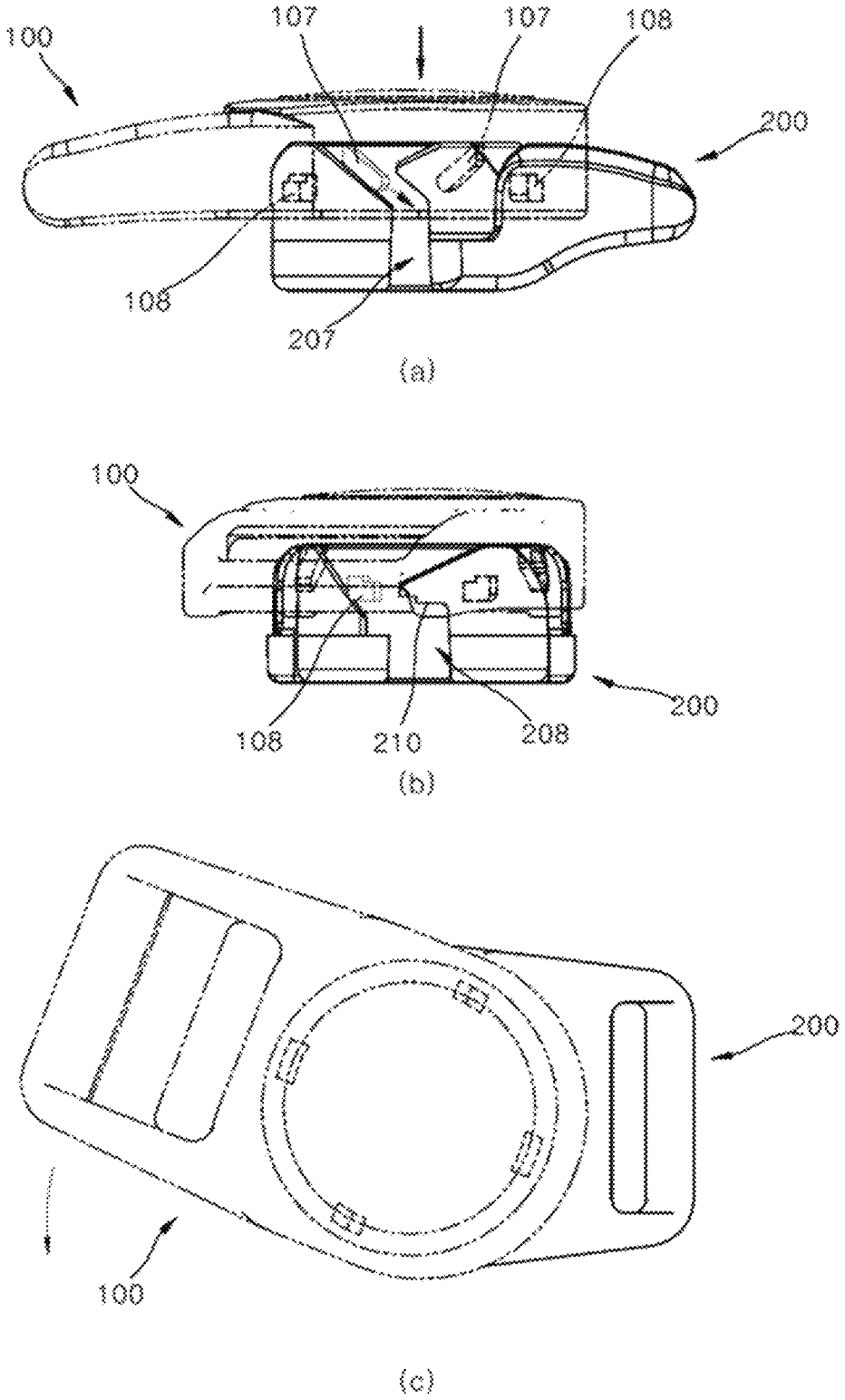
FIGS. 10 and 11 are views for explaining an action of the buckle according to the present invention.
Figure 11:
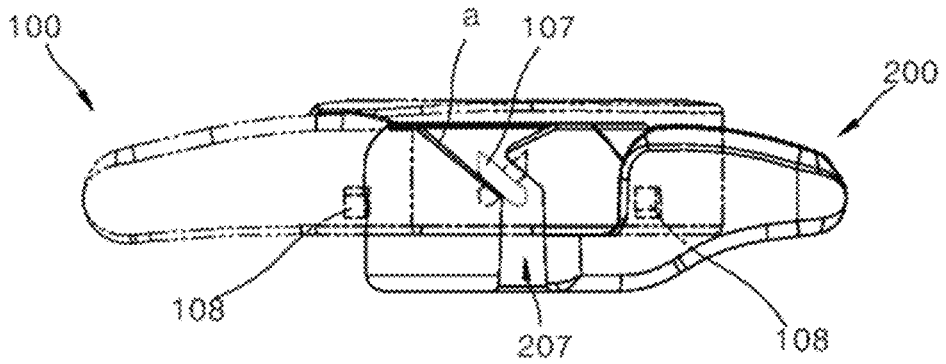
Figure 11:
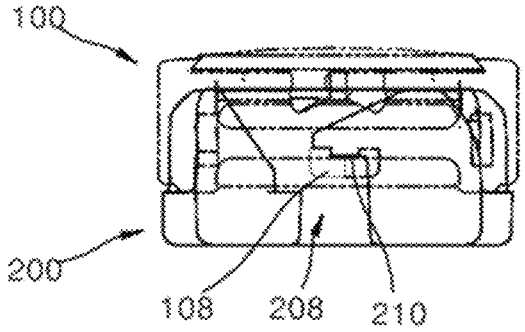
Figure 11:
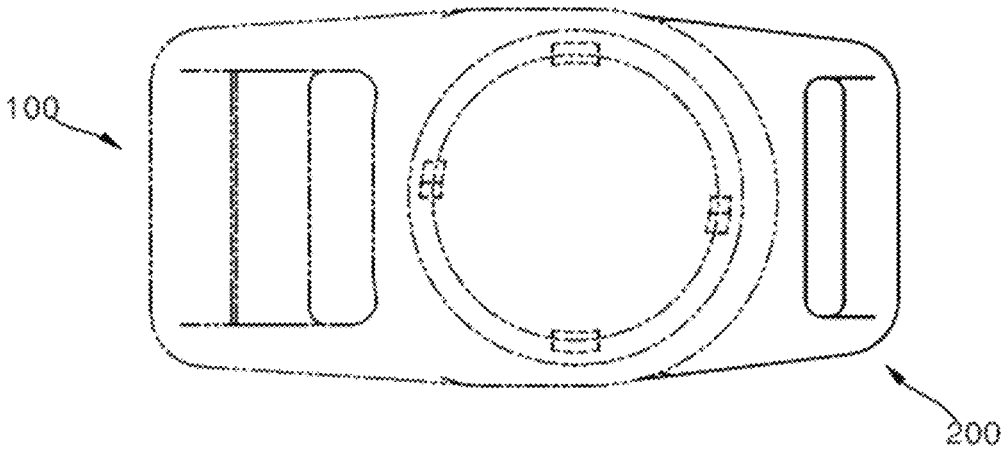

FIGS. 10 and 11 are views showing the state where the plug member 100 and the socket member 200 are coupled with each other.

FIG. 10 illustrates the state directly before the plug member 100 and the socket member 200 come into contact with each other to be perfectly coupled with each other, wherein FIG. 10(*a*) illustrates the state where the guide protrusion 107 enters into the guide groove 207, FIG. 10(*b*) illustrates the state where the retaining protrusion 108 enters into the retaining groove 208, and FIG. 10(*c*) is a plan view illustrating a coupling angle between the plug member 100 and the socket member 200.

The plug member 100 and the socket member 200 are perfectly coupled with each other as shown in FIG. 11 when the guide protrusion 107 and the retaining protrusion 108 enter along the inclined surface through the inclined approaches (a) of the guide groove 207 and the retaining groove 208 by a slight rotation as shown in FIG. 10.

FIG. 11(*a*) illustrates positions of the guide protrusion 107 and the guide groove 207 when the plug member 100 and the socket member 200 are perfectly coupled with each other, and FIG. 11(*b*) illustrates a position of the retaining protrusion 108 in the retaining groove 208. As described above, the retaining protrusion 108 enters below the retaining part 210 of the retaining groove 208 and is located to prevent it from being separated vertically upwards. As shown in FIG. 11(*c*), the plug member 100 and the socket member 200 are coupled with each other to be parallel to each other.

Such a series of coupling processes happen momentarily by the strong magnetism of the first magnet 120 and the second magnet 220, and since the entrances of the guide groove 207 and the retaining groove 208 are expanded in two ways so that the guide protrusion 107 and the retaining protrusion 108 enter as much as they are sucked into the guide groove 207 and the retaining groove 208.

Moreover, the inclined approaches (a) of the guide groove 207 and the retaining groove 208 are all formed in the same rotational direction, so that the plug member 100 or the socket member 200 slightly rotates in the inclined direction of the inclined approach (a), and at the same time, the plug member 100 and the socket member 200 are coupled with each other.

In the coupled state, when the user simply pulls or vertically raises the plug member 100 and the socket member 200, they are not separated from each other due to the coupling relation between the retaining protrusion 108 and the retaining part 210.

In order to separate the plug member 100 from the socket member 200, when the plug member 100 is rotated in the reverse direction to the coupling direction of the plug member 100, the guide protrusion 107 is pushed upwards while getting in contact with the inclined surface of the inclined approach (a), the plug member 100 and the socket member 200 are pushed in the opposite directions to each other naturally, and at the same time, the retaining protrusion 108 is released from the retaining part 210, so that the plug member 100 is easily separated from the socket member 200.

Because the plug member 100 and the socket member 200 are momentarily coupled with each other by the magnets, the user can connect and disconnect belts or straps with one hand. As described above, the user can operate the buckle just with one hand and the coupled state can be kept as it is as long as someone does not rotate the plug member 100 and the socket member 200 intentionally. Therefore, the user can use the buckle in safety.

Hereinafter, buckles according to other embodiments of the present invention will be described, and in the other embodiments, detailed descriptions of the same parts as the basic structure described above will be omitted.

Figure 12:
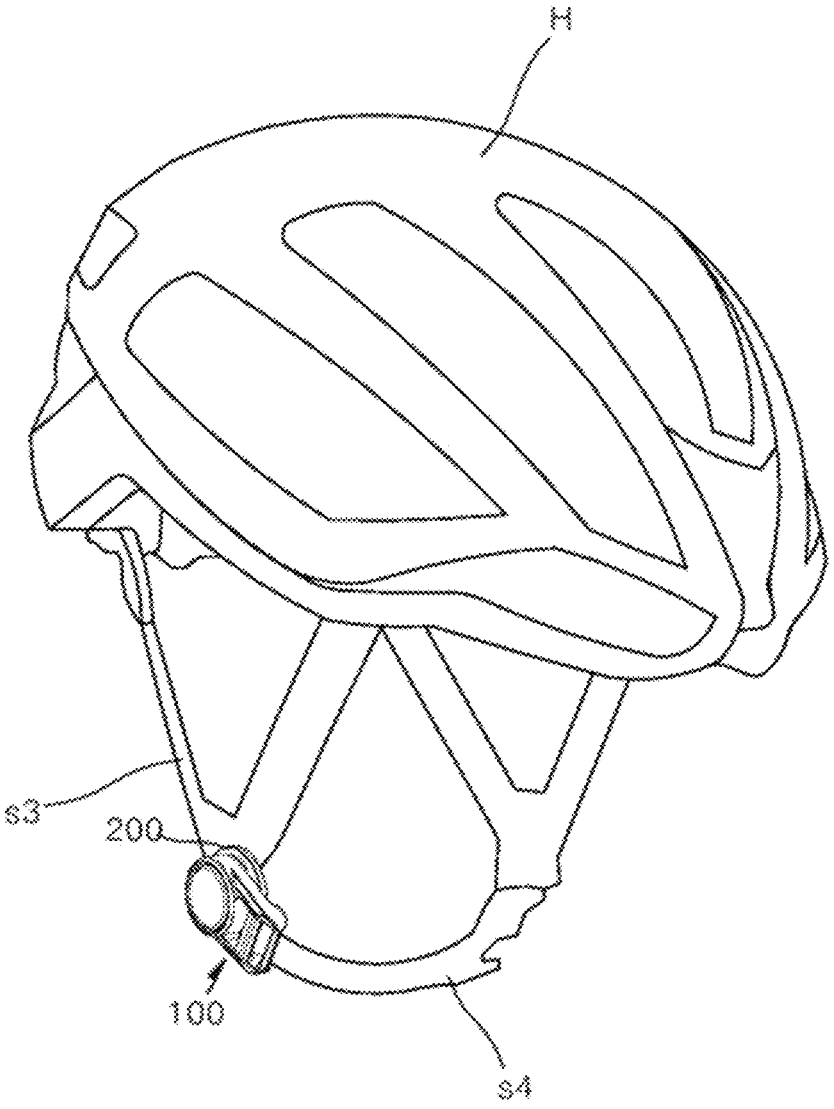
FIGS. 12 to 14 are views illustrating that the buckle according to the present invention is applied to a strap for a helmet.
Figure 13:
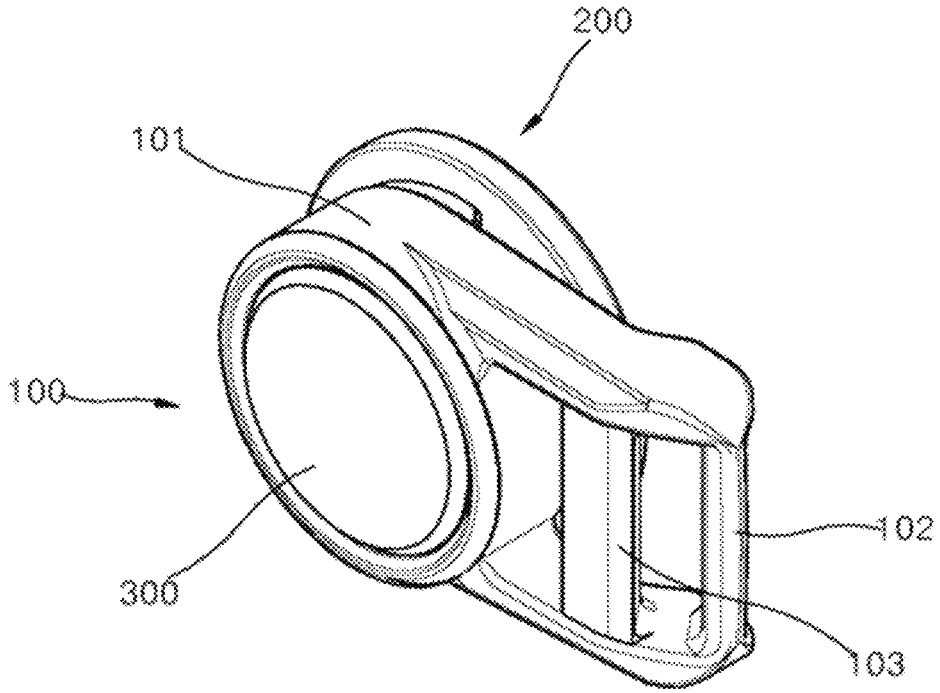
Figure 13:
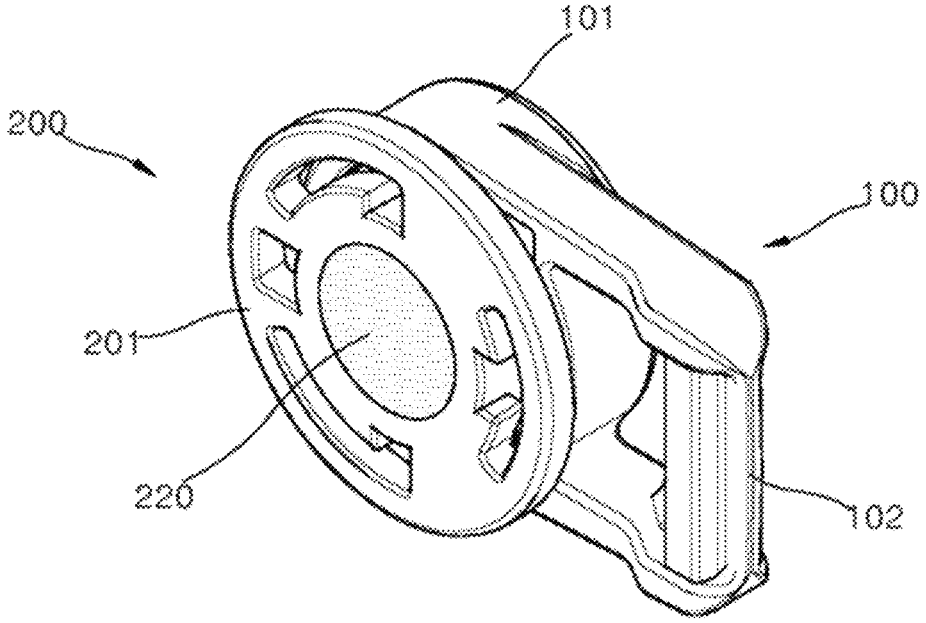
Figure 14:
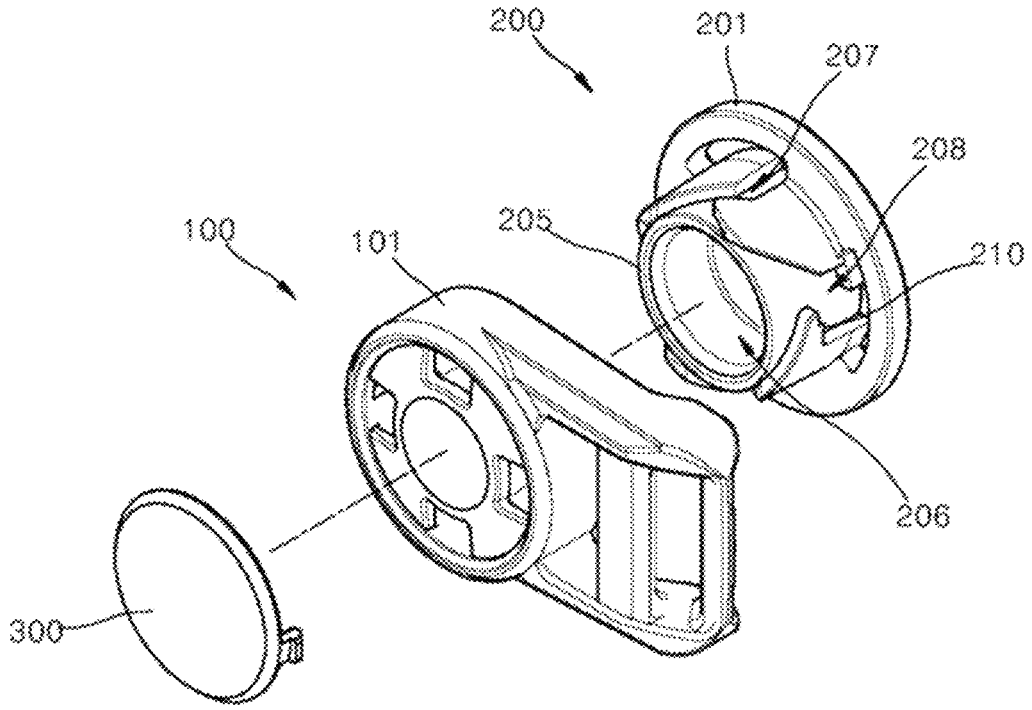
Figure 14:
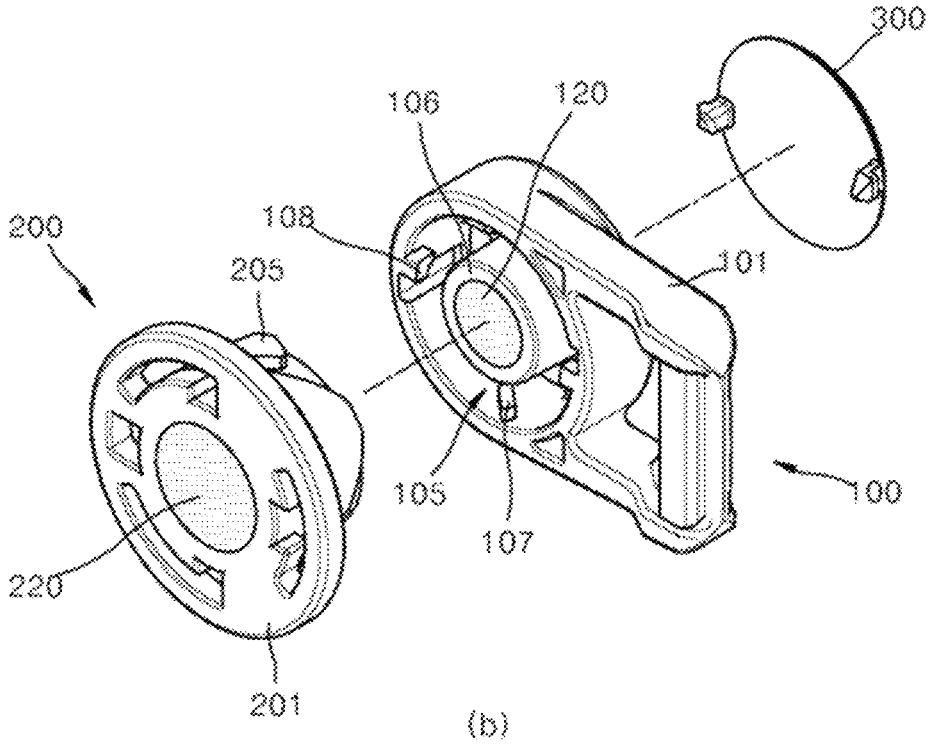

FIGS. 12 to 14 are views illustrating that the buckle according to the present invention is applied to a strap for a helmet, wherein FIG. 12 illustrates a used state, FIGS. 13(*a*) and 13(*b*) are a perspective view and a rear side perspective view of FIG. 12, and FIGS. 14(*a*) and 14(*b*) are an exploded perspective view and a rear side exploded perspective view.

Referring to FIGS. 12 to 14, the socket member 200 is fixed on a side strap s3 of a helmet (H), and the plug member 100 is mounted at a chin strap s4. The plug member 100 has the cross bar 102 and the strap hooking bar 103 formed at one side of the first body so as to connect and control the chin strap s4.

Even in this instance, the connection recess 105 and the connection protrusion 205 are respectively formed on the bodies 101 and 201 of the plug member 100 and the socket member 200, and the first magnet 120 and the second magnet 220 are inserted and mounted into the connection recess 105 and the connection protrusion 205, so that the plug member 100 and the socket member are simply coupled with each other by magnetism when approaching each other. That is, the plug member 100 and the socket member 200 can keep the coupled state stable since being easily coupled with each other and separated from each other through coupling of the guide protrusion 107 and the guide groove 207 and coupling of the retaining protrusion 108 and the retaining groove 208.

Figure 15:
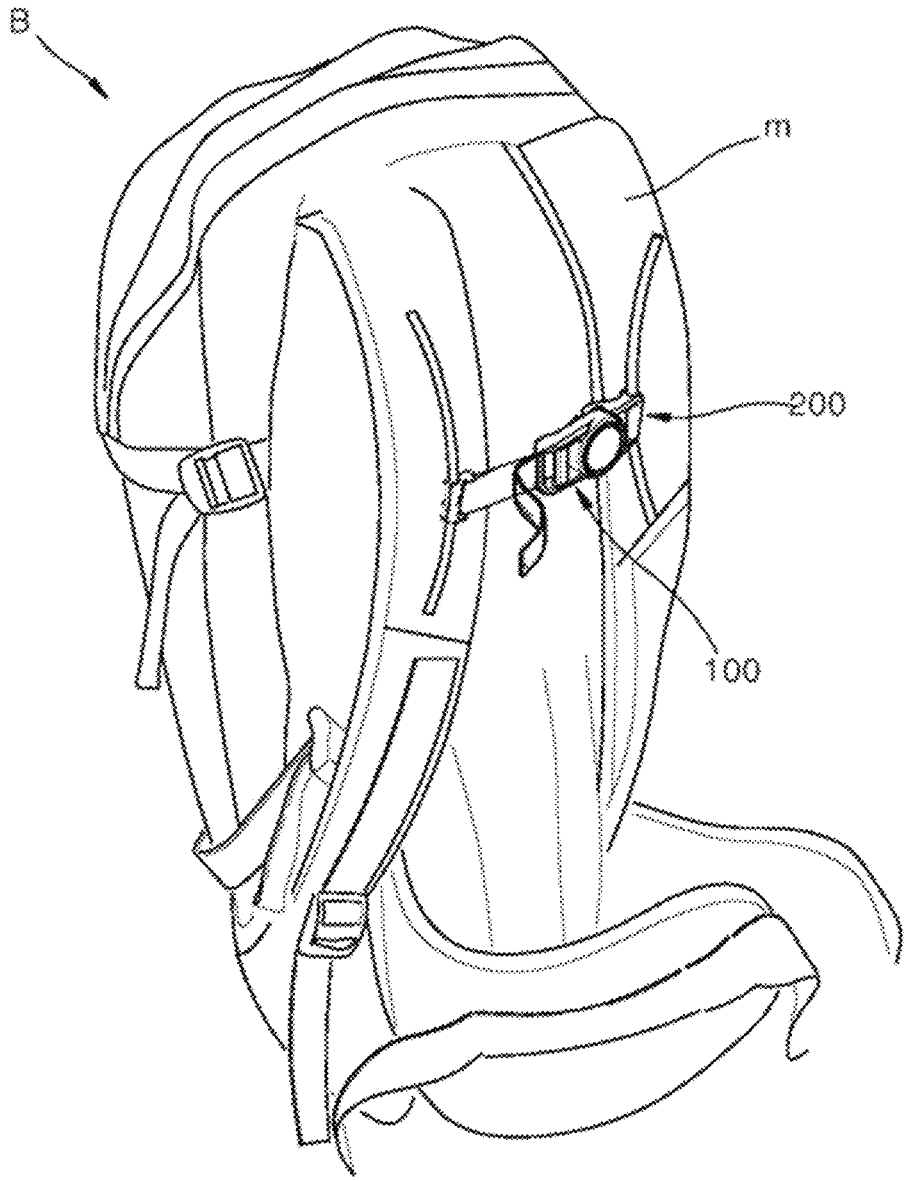
FIGS. 15 to 17 are views illustrating that the buckle according to the present invention is applied to chest suspender straps.
Figure 16:
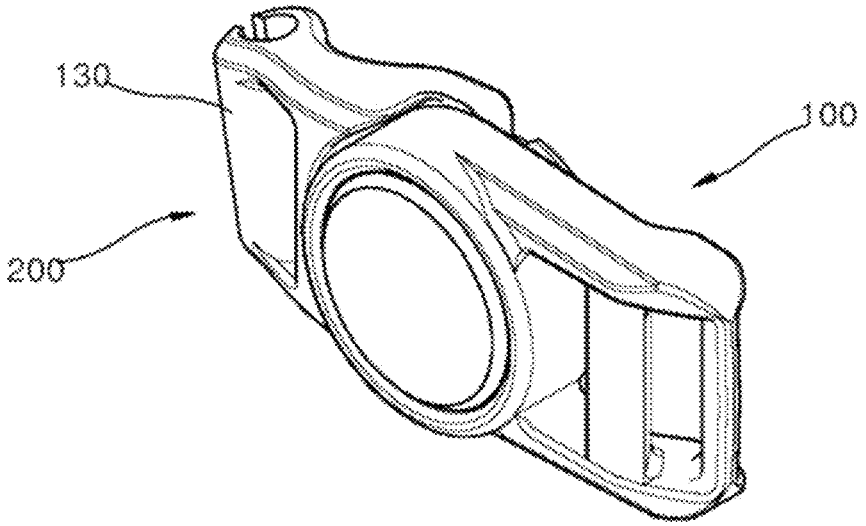
Figure 16:
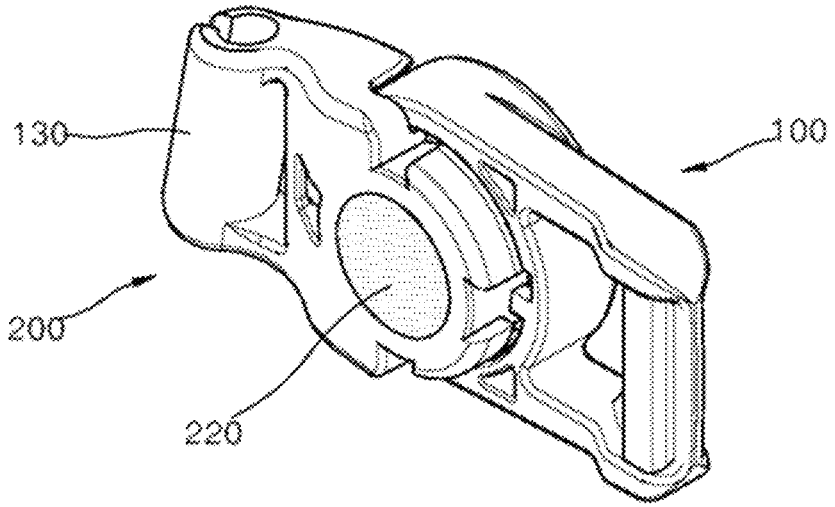
Figure 17:
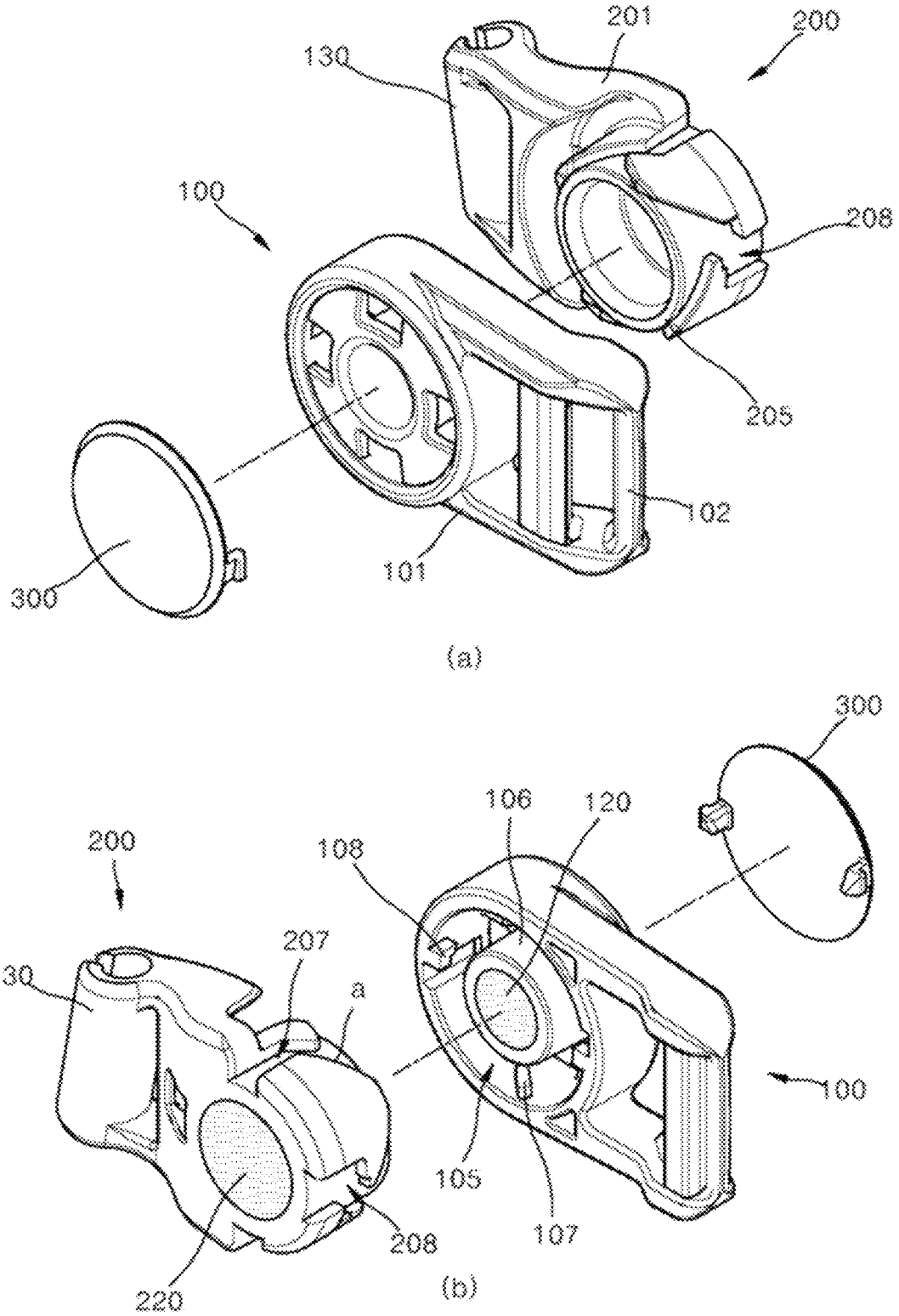

FIGS. 15 to 17 are views illustrating that the buckle according to the present invention is applied to an elevation buckle of a chest suspender of a backpack (B). The socket member 200 coupled with the plug member 100 has an elevator rail holder 130 formed at one side thereof in place of the cross bar to be mounted on the chest suspender (m) of the backpack (B). Alternatively, the elevator rail holder 130 may be applied to the plug member 100.

The elevation buckle is mounted on the chest suspender of the backpack to be elevated. Even in this instance, the first magnet 120 and the second magnet 220 are respectively mounted on the plug member 100 and the socket member 200 so that the plug member and the socket member can be simply coupled with each other by magnetism of the first and second magnets 120 and 220 when they approach each other. That is, the plug member 100 and the socket member 200 can keep the coupled state stable since being easily coupled with each other and separated from each other through coupling of the guide protrusion 107 and the guide groove 207 and coupling of the retaining protrusion 108 and the retaining groove 208.

Figure 18:
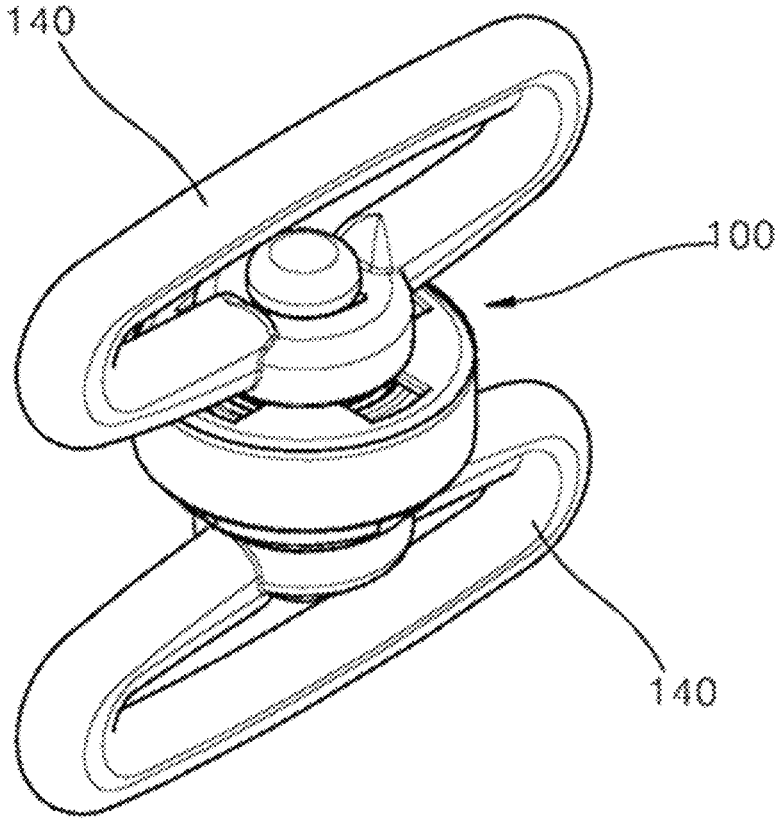
FIGS. 18 and 19 are views illustrating that the buckle according to the present invention is applied to strap connectors.
Figure 19:
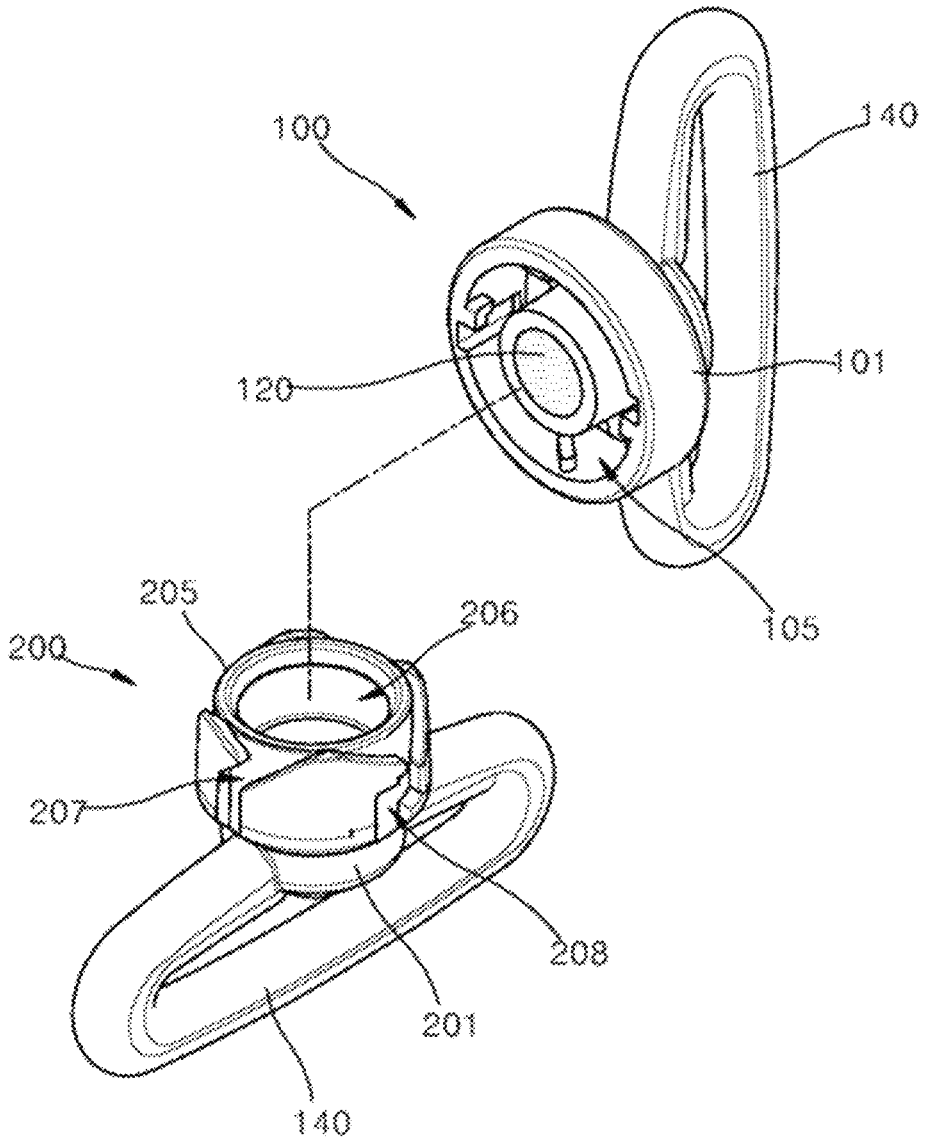

FIGS. 18 and 19 are a perspective view and an exploded perspective view illustrating that the buckle according to the present invention is applied to a pair of strap connectors. The plug member 100 and the socket member 200 respectively have strap connectors 140 formed integrally with the rear sides of the bodies thereof, and straps are respectively connected to the strap connectors 140 to be used detachably. The plug member 100 and the socket member 200 are coupled with each other by magnetism of the magnets and the connection recess 105 and the connection protrusion 205.

Figure 20:
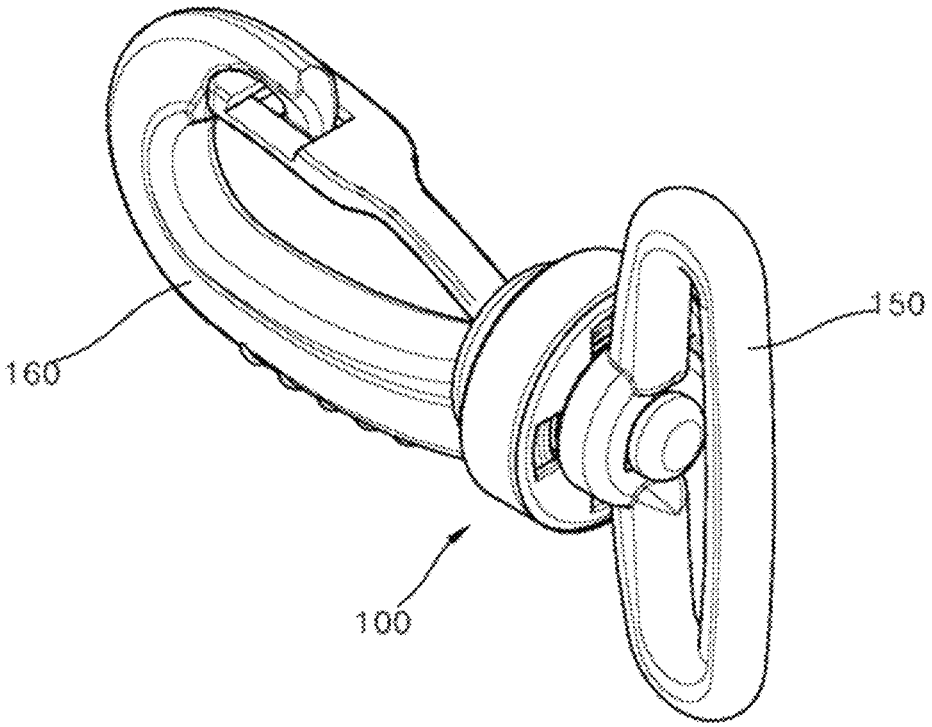
FIGS. 20 and 21 are views illustrating that the buckle according to the present invention is applied to a rotating ring and a rotating hook.
Figure 21:
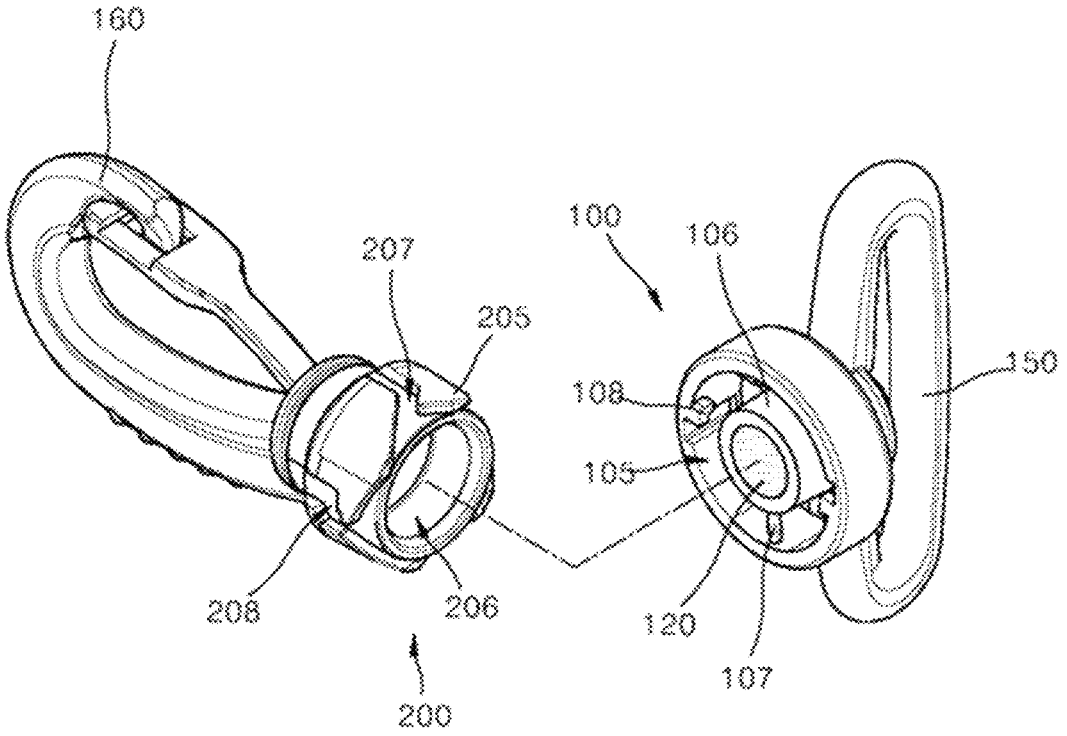

FIGS. 20 and 21 are a perspective view and an exploded perspective view illustrating that the buckle according to the present invention is applied to a rotating ring and a hook. The plug member 100 and the socket member 200 respectively have a rotating ring 150 and a hook 160 formed at the rear sides thereof. The plug member 100 and the socket member 200 are coupled with each other by magnetism of the magnets and the connection recess 105 and the connection protrusion 205.

Figure 22:
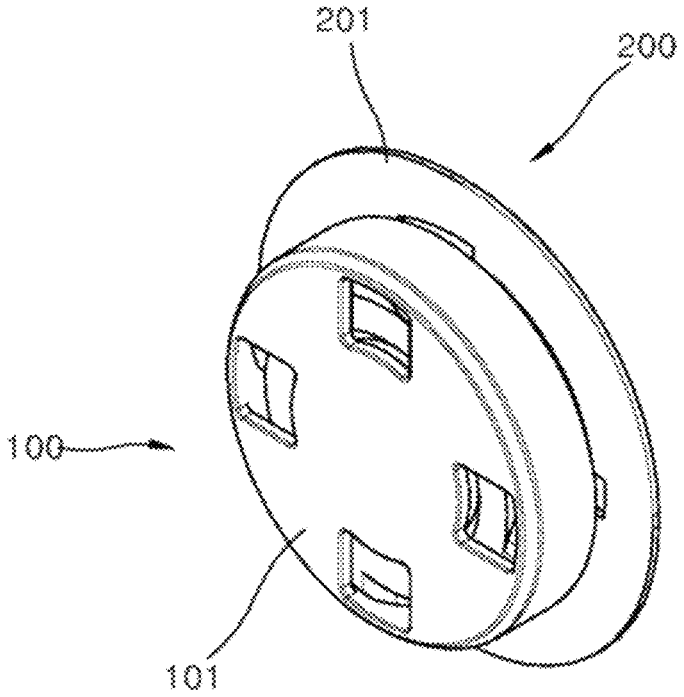
FIGS. 22 and 23 are perspective views illustrating that the buckle according to the present invention is applied to a bag or a backpack.
Figure 23:
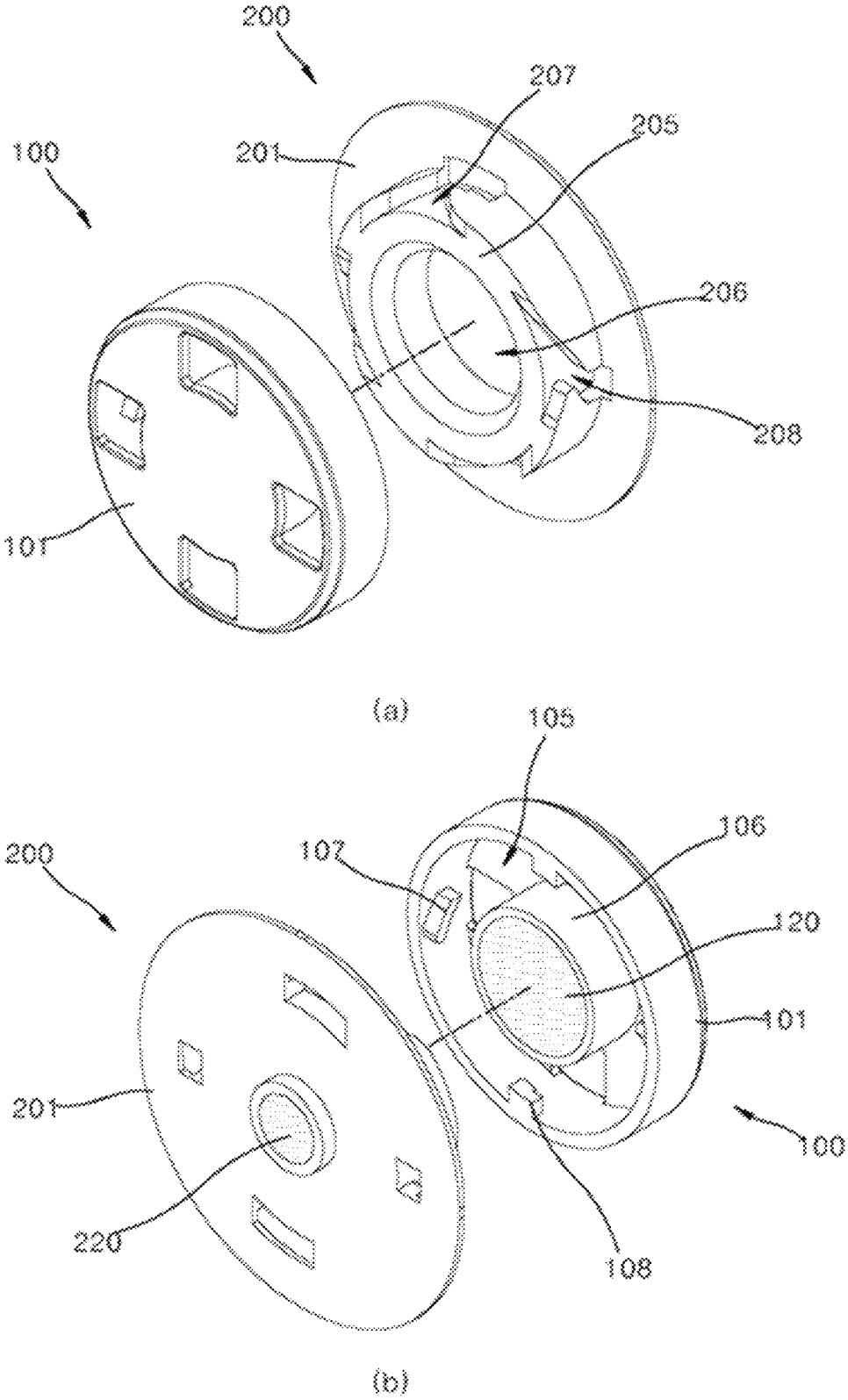

FIGS. 22 and 23 are a perspective view and an exploded perspective view illustrating that the buckle according to the present invention is applied to a bag in order to open and close the bag. For instance, the socket member 200 is attached to a body of the bag and the plug member 100 is attached to a cover of the bag so as to be used as a means for opening and closing the bag.

Even in this instance, the plug member and the socket member can be easily coupled with each other by magnetism of the first magnet 120 of the plug member 100 and the second magnet 220 of the socket member 200 and by coupling of the connection recess 105 and the connection protrusion 205.

Additionally, various means for connecting articles, such as rings, whistles, strap fasteners, hooks or others may be applied to one side of the body of the buckle according to the present invention.

Figure 24:
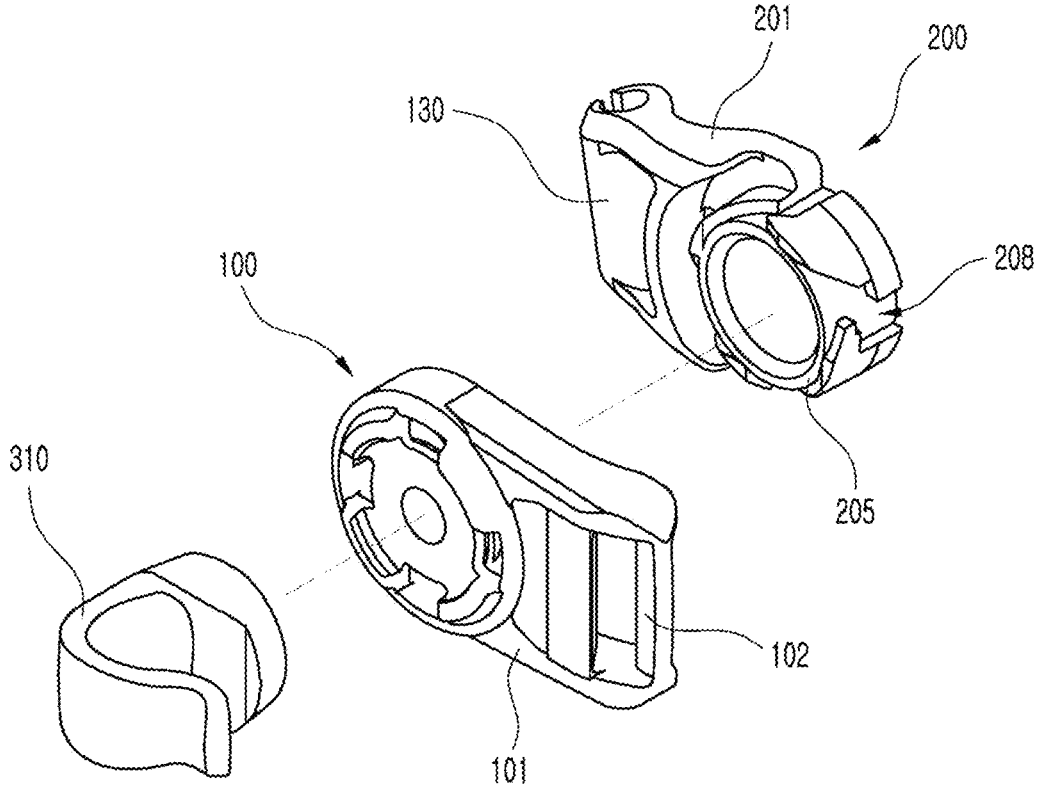
FIG. 24 is an exploded perspective view illustrating a buckle according to another embodiment of the present invention including a connection member.
Figure 25:
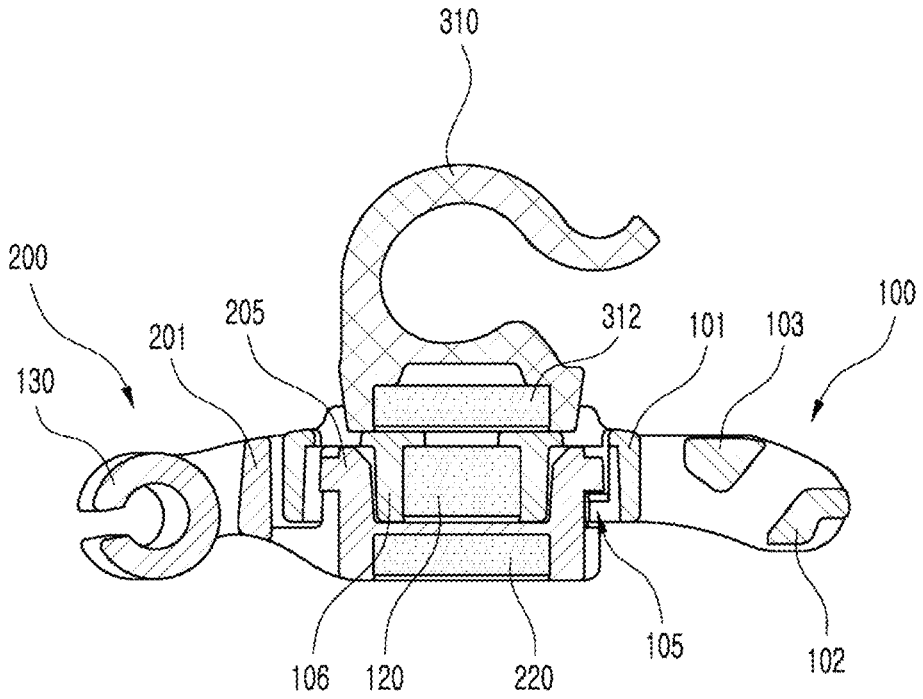
FIG. 25 is a sectional view illustrating a state in which the buckle of FIG. 24 is coupled.
Figure 26:
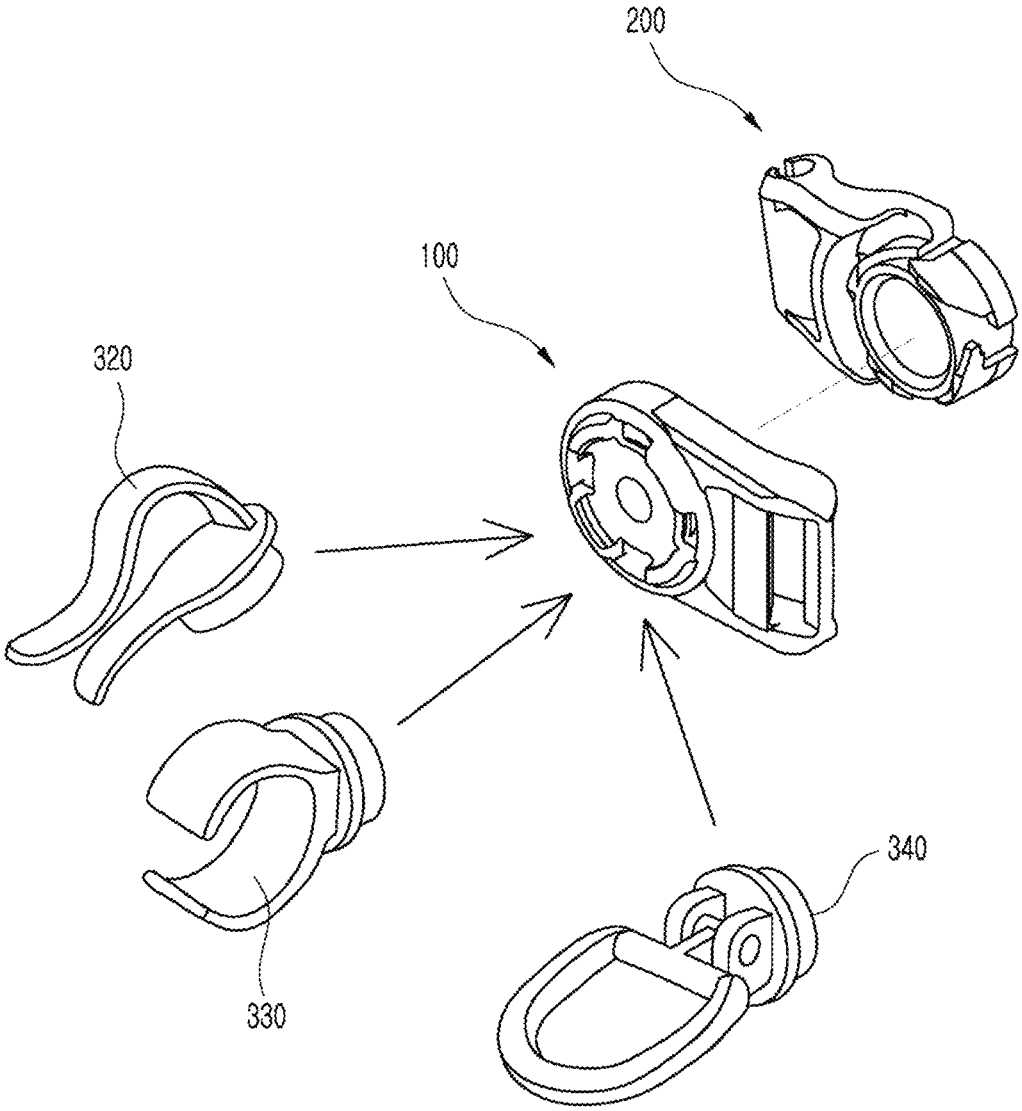
FIG. 26 is a view illustrating the buckle including various connection members according to the present invention.

FIGS. 24 to 26 are views illustrating a buckle according to another embodiment of the present invention further including a connection member, wherein FIG. 24 is an exploded perspective view illustrating a buckle according to another embodiment of the present invention including a connection member, FIG. 25 is a sectional view illustrating a state in which the buckle of FIG. 24 is coupled, and FIG. 26 is a view illustrating the buckle including various connection members according to the present invention.

In this embodiment, the buckle is described as being made of coupling a connecting member and the elevation buckle shown in FIGS. 15 to 17 described above. However, this is exemplary and not limited thereto, and the connection member may be coupled to the buckle according to the other embodiment of the present invention other than the elevation buckle.

The buckle according to the embodiment of the present invention includes the plug member 100, the socket member 200, and a connection member 310. Since the plug member 100 and the socket member 200 are substantially the same as the plug member and the socket member described in the previous embodiment, detailed descriptions are omitted.

The connection member 310 may be made of a hose clip that can fix a hose inserted thereinto as shown in FIG. 24. The connection member 310 is coupled to the plug member 100 instead of the cap 300 where the cap 300 is located.

FIG. 25 is a sectional view of the buckle in which the plug member 100, the socket member 200, and the connection member 310 are coupled. As shown in FIG. 25, the connection member 310 includes a third magnet 312 inside the bottom contacting the plug member 100. In order to couple the plug member 100 and the connection member 310 with each other, when the connection member 310 approaches the plug member 100, they are strongly drawn to each other by magnetism of the first magnet 120 and the third magnet 312, so that the first magnet 120 and the third magnet 312 are attached to each other in a moment and the plug member 100 and the connection member 310 are closely coupled with each other. And the coupling of the plug member 100 and the connection member 310 can be easily released by applying a force greater than the magnetism of the first magnet 120 and the third magnet 312.

Although the connection member 310 has been described as being coupled to the plug member 100 instead of the cap 300 where the cap 300 is located, unlike this, the connection member 310 may be coupled to a portion where the second magnet 220 of the socket member 200 is inserted.

The connection member 310 may be made of hydration tube clip 320, light clip 330, swiveling D-ring 340, O-ring, etc. as shown in FIG. 26 instead of the hose clip. They also have a magnet therein to function the same as the connection member 310.

Although exemplary embodiments of the present invention have been disclosed for illustrative purposes, it will be appreciated that the present invention is not limited thereto, and those skilled in the art will appreciate that various modifications and substitutions are possible, without departing from the scope and spirit of the invention. For instance, the connection recess, the connection protrusion, the guide groove, the guide protrusion, the retaining groove, and the retaining protrusion may be varied in their shapes or coupled states if necessary, and part added to the plug member and the socket member may be applied in various forms if necessary.

What is claimed is:

1. A buckle comprising:

a plug member having a shaft part protruding from one side of a first body, a first magnet inserted into the shaft part, a connection recess formed on an outer face of the shaft part, and a pair of guide protrusions formed on an inner wall of the connection recess; and a socket member having a connection protrusion formed on one side of a second body to be inserted into the connection recess, a coupling recess formed in a middle of the connection protrusion so that the shaft part is inserted into the coupling recess, a second magnet inserted into the coupling recess, and a pair of guide grooves formed in an outer surface of the connection protrusion to guide the pair of guide protrusions, wherein the plug member and the socket member are coupled with each other in a detachable manner, wherein the pair of guide grooves includes a pair of retaining grooves each having a retaining part formed in a middle of each retaining groove, and the pair of guide protrusions coupled to the pair of retaining grooves includes a pair of retaining protrusions each of which is caught to the retaining part not to be separated from the socket member, and wherein the pair of guide grooves are formed in the outer surface of the connection protrusion of the socket member to face each other, the pair of guide protrusions coupled with the pair of guide grooves are formed on the inner wall of the connection recess of the plug member to face each other, the pair of the retaining grooves are formed in the outer surface of the connection protrusion to face each other, and the pair of retaining protrusions coupled with the pair of retaining grooves are formed on the inner wall of the connection recess to face each other.

2. The buckle according to claim 1, wherein each guide groove has an inclined approach formed to be inclined from an entrance where each guide protrusion enters to a middle of each guide groove.

3. The buckle according to claim 1, wherein an entrance of each guide groove is expanded in two ways so that each guide protrusion enters easily.

4. The buckle according to claim 2, wherein each guide protrusion is inclined in the same direction as the inclined approach.

5. The buckle according to claim 1, wherein each of the pair of retaining grooves has an inclined approach formed to be inclined from an entrance where each retaining protrusion enters to a middle of each retaining groove, the retaining part is formed to be opposed to the inclined approach, and a horizontal movement section is formed at an end of the inclined approach and below the retaining part.

6. The buckle according to claim 5, wherein the pair of retaining protrusions facing each other is formed to be deviated from a center of the connection recess.

7. The buckle according to claim 1, wherein the retaining part has a stepped jaw formed at a front end portion thereof.

8. The buckle according to claim 1, wherein each retaining protrusion has a stepped jaw formed on a surface getting in contact with the retaining part.

9. The buckle according to claim 1, further comprising:

a cap attached to an outer surface of the first body.

10. The buckle according to claim 9, wherein the first body has at least a pair of grooves formed in the outer surface of the first body and a retaining jaw formed therein, and the cap has a hook part coupled to the retaining jaw.

11. The buckle according to claim 1, wherein the first body or the second body has a cross bar and a strap hooking bar selectively formed at one side.

12. The buckle according to claim 1, wherein the first body or the second body has an elevator rail holder disposed at one side.

13. The buckle according to claim 1, wherein the first body or the second body has a connection member selected from a ring, a clip, a hook, a buckle, and a strap connector, which is disposed integrally with one side thereof.

14. The buckle according to claim 1, wherein the first body or the second body has a whistle attached to one side.

15. The buckle according to claim 1, wherein the first body or the second body has a flat connector disposed at one side and sewed to a bag or a strap.

16. The buckle according to claim 1, further comprising:

a connection member having a third magnet, wherein the connection member and the plug member are coupled with each other by magnetism of the first magnet and the third magnet, or the connection member and the socket member are coupled with each other by magnetism of the second magnet and the third magnet.

17. The buckle according to claim 16, wherein the connection member has any one of a hose clip, a hydration tube clip, a light clip, a swiveling D-ring, and a swiveling O-ring.

* * * * *